US012339043B2

(12) United States Patent
Son et al.

(10) Patent No.: US 12,339,043 B2
(45) Date of Patent: Jun. 24, 2025

(54) COMPRESSOR

(71) Applicant: LG Electronics Inc., Seoul (KR)

(72) Inventors: Sangik Son, Seoul (KR); Youngpil Kim, Seoul (KR); Kyungmin Lee, Seoul (KR); Wooju Jeon, Seoul (KR)

(73) Assignee: LG Electronics Inc., Seoul (KR)

( * ) Notice: Subject to any disclaimer, the term of this patent is extended or adjusted under 35 U.S.C. 154(b) by 792 days.

(21) Appl. No.: 17/067,304

(22) Filed: Oct. 9, 2020

(65) Prior Publication Data

US 2021/0108837 A1 Apr. 15, 2021

(30) Foreign Application Priority Data

Oct. 10, 2019 (KR) ..... 10-2019-0125578

(51) Int. Cl.
*F25B 31/02* (2006.01)
*F04B 53/14* (2006.01)
(Continued)

(52) U.S. Cl.
CPC ..... *F25B 31/023* (2013.01); *F04B 53/14* (2013.01); *F04B 53/16* (2013.01); *F25B 31/002* (2013.01); *F25B 2400/073* (2013.01)

(58) Field of Classification Search
CPC ..... F25B 31/023; F25B 31/002; F25B 2400/073; F04B 53/14; F04B 53/16;
(Continued)

(56) References Cited

U.S. PATENT DOCUMENTS 10,273,955 B2 * 4/2019 Bean ..... F04B 15/08
11,261,855 B2 * 3/2022 Jeon ..... F04B 39/16
(Continued)

FOREIGN PATENT DOCUMENTS

KR 101265133 5/2013
KR 1020140030743 3/2014
(Continued)

OTHER PUBLICATIONS

Korean Office Action in Korean Application No. 10-2019-0125578, dated Aug. 26, 2020, 10 pages (with English translation).
(Continued)

*Primary Examiner* — Dominick L Plakkoottam
(74) *Attorney, Agent, or Firm* — Fish & Richardson P.C.

(57) ABSTRACT

A compressor includes: a cylinder in which a piston is accommodated, the cylinder defining a compression space that is configured, based on the piston reciprocating in an axial direction, to compress a refrigerant gas therein, and a frame configured to accommodate the cylinder therein and defining a gas hole configured to pass the refrigerant gas therethrough. The gas hole is configured to communicate with an outside of the frame to receive the refrigerant gas and communicate with a gas pocket that is defined between an inner circumferential surface of the frame and an outer circumferential surface of the cylinder. The outer circumferential surface of the cylinder or the inner circumferential surface of the frame provides a plurality of restrictor regions partitioned by a gas supply passage, the gas supply passage defined to be recessed at the cylinder and configured to communicate with the gas hole.

19 Claims, 21 Drawing Sheets

(51) Int. Cl.
*F04B 53/16* (2006.01)
*F25B 31/00* (2006.01)

(58) Field of Classification Search
CPC .... F04B 39/0292; F04B 39/04; F04B 39/123; F04B 39/16; F04B 35/045; F04B 39/12
See application file for complete search history.

(56) References Cited

U.S. PATENT DOCUMENTS

| | | | | |
|---|---|---|---|---|
| 2013/0058816 | A1* | 3/2013 | Kim | F04B 35/045 417/437 |
| 2014/0053720 | A1* | 2/2014 | Ahn | F04B 39/122 91/418 |
| 2014/0283679 | A1 | 9/2014 | Muhle et al. | |
| 2015/0369225 | A1* | 12/2015 | Ha | F04B 39/122 417/443 |
| 2018/0195502 | A1* | 7/2018 | Ahn | F04B 53/008 |
| 2018/0195504 | A1* | 7/2018 | Lee | F04B 39/125 |
| 2020/0149518 | A1* | 5/2020 | Jeon | F04B 39/126 |

FOREIGN PATENT DOCUMENTS

| | | | |
|---|---|---|---|
| KR | 1020140099487 | | 8/2014 |
| KR | 20150031723 | | 3/2015 |
| KR | 20150031723 | A * | 3/2015 |
| KR | 20150040027 | | 4/2015 |
| KR | 20160024217 | | 3/2016 |
| KR | 1020170124903 | | 11/2017 |

OTHER PUBLICATIONS

Korean Notice of Allowance in KR Appln. No. 2021-007121909, dated Jan. 25, 2021, 4 pages (with English translation).

* cited by examiner (a)

(b)

COMPRESSOR

CROSS-REFERENCE TO RELATED APPLICATIONS

This application claims the benefit of the Korean Patent Application No. 10-2019-0125578 filed on Oct. 10, 2019, which is hereby incorporated by reference as if fully set forth herein.

BACKGROUND

Field of the Invention

The present disclosure relates to a compressor, and more particularly, to a linear compressor for compressing a refrigerant by a linear reciprocating motion of a piston.

Discussion of the Related Art

In general, a compressor refers to a device configured to compress a working fluid such as air or a refrigerant upon receiving power from a power generating device such as a motor or a turbine. Compressors are widely applied to overall industry or home appliances, in particular, a steam compression type refrigerating cycle (hereinafter, referred to as a 'refrigerating cycle').

These compressors may be classified into a reciprocating compressor, a rotary compressor, and a scroll compressor depending on how a refrigerant is compressed.

The reciprocating compressor is based on a method in which a compression space is formed between a piston and a cylinder and the piston linearly reciprocates to compress a fluid, the rotary compressor is based on a method in which a fluid is compressed by a roller eccentrically rotated inside a cylinder, and the scroll compressor is based on a method in which a pair of spiral scrolls are engaged and rotated to compress a fluid.

Recently, the use of a linear compressor using a linear reciprocating motion without using a crankshaft, among reciprocating compressors, is gradually increasing. The linear compressor has the advantage of having improved efficiency and having a relatively simple structure because there is little mechanical loss in converting a rotational motion to a linear reciprocating motion.

In the linear compressor, a cylinder is located inside a casing forming a closed space to form a compression chamber, and a piston covering the compression chamber may be configured to reciprocate inside the cylinder. In the linear compressor, a fluid in the closed space is sucked into the compression chamber while the piston is located at a bottom dead center (BDC) and the fluid in the compression chamber is compressed and discharged while the piston is located at a top dead center (TDC), and this process is repeated.

Meanwhile, the linear compressor may be classified into an oil-lubricated linear compressor and a gas-lubricated linear compressor according to a lubrication method.

The oil-lubricated linear compressor is configured to lubricate a space between a cylinder and a piston using oil by storing a certain amount of oil in a casing as disclosed in Patent Document 1 (Korean Patent Laid-Open Publication No. 10-2015-0040027). Meanwhile, the gas-lubricated linear compressor is configured to lubricate a space between a cylinder and a piston by gas power of a refrigerant by guiding part of the refrigerant discharged from a compression space without storing oil inside a casing as disclosed in Patent Document 2 (Korean Patent Laid-Open Publication No. 10-2016-0024217).

In the oil-lubricated linear compressor, oil having a relatively low temperature is supplied between the cylinder and the piston, and thus the cylinder and the piston may be restrained from being overheated by motor heat or compression heat. Accordingly, in the oil-lubricated linear compressor, a refrigerant passing through a suction flow path of the piston is heated, while being sucked into a compression chamber of the cylinder, to suppress an increase in specific volume to thereby prevent the occurrence of suction loss.

However, in the oil-lubricated linear compressor, if the oil discharged along with the refrigerant to a refrigerating cycle device is not smoothly recovered to the compressor, oil shortage may occur inside the casing of the compressor and oil shortage in the casing may degrade reliability of the compressor.

Meanwhile, the gas-lubricated linear compressor is advantageously reduced in size compared to the oil-lubricated linear compressor and reliability of the compressor due to oil shortage does not occur because the refrigerant lubricates a space between the cylinder and the piston.

In the gas-lubricated linear compressor as described above, thread is wound around an inlet of a gas intake hole through which a lubricating gas is introduced into the cylinder to prevent dirt from being introduced.

However, when the thread is mounted on the cylinder, a portion of the thread is heat-fused, and the heat-fused portion is damaged over time to reduce tension, causing a problem of reducing restrictor performance for pressure reduction, as well as a filter function of the thread. In addition, when the thread is mounted on the cylinder, it is mounted with tension applied thereto, and tension of the thread continuously acting on the cylinder may deform durability of the cylinder.

RELATED ART DOCUMENT (Patent document 1) Korean Patent Laid-Open Publication No. KR10-2015-0040027 A (Published on Apr. 14, 2015)

(Patent document 1) Korean Patent Laid-Open Publication No. KR10-2016-0024217 A (Published on Mar. 4, 2016)

SUMMARY

An aspect of the present disclosure is directed to providing a compressor capable of preventing oil from flowing into a sliding part.

Another aspect of the present disclosure is directed to providing a compressor capable of performing a filter function, while performing a restrictor function for reducing pressure of a refrigerant flowing into a cylinder in a gas bearing system, by changing a shape of the cylinder or a frame.

To achieve these and other advantages and in accordance with the purpose of the disclosure, as embodied and broadly described herein, there is provided a compressor including: a cylinder in which a piston is accommodated and configured to form a compression space in which a refrigerant gas is compressed as the piston reciprocates in an axial direction; and a frame configured to accommodate the cylinder therein and having a gas hole in which the refrigerant gas flows, wherein one side of the gas hole communicates with outside so that the refrigerant gas is introduced and the other side of the gas hole communicates with a gas pocket including a space between an inner circumferential surface of the frame and an outer circumferential surface of the cylinder, a gas supply passage communicating with the gas hole and configured to be recessed and a plurality of restrictor regions partitioned by the gas supply passage are provided on the outer circumferential surface of the cylinder or the inner circumferential surface of the frame, and a gas intake hole communicating with inner space of the cylinder and the gas pocket are formed in the restrictor region or a region of the cylinder facing the restrictor region.

The gas supply passage may include a first-directional gas supply passage extending in a longitudinal direction of the cylinder and a second-directional gas supply passage extending in a circumferential direction of the cylinder, wherein the restrictor region may be partitioned by the first-directional gas supply passage and the second-directional gas supply passage.

The first-directional gas supply passage may be provided in plurality along the circumferential direction of the cylinder, the second-directional gas supply passage may be provided in plurality along the longitudinal direction of the cylinder, and the restrictor region may be provided in plurality in the longitudinal direction of the cylinder and provided in plurality of in the circumferential direction of the cylinder.

The plurality of restrictor regions provided in the circumferential direction of the cylinder may have the same width in the axial direction.

The plurality of restrictor regions provided in the longitudinal direction of the cylinder may have different widths each other in the axial direction.

The restrictor region provided at a front part of the cylinder or the frame facing the front part of the cylinder may have a width smaller than a width of the restrictor region provided at a rear part of the cylinder or the frame facing the rear part of the cylinder.

The plurality of second-directional gas supply passages may have different widths each other in the longitudinal direction of the cylinder.

A first second-directional gas supply passage provided at the front part of the cylinder or the frame facing the front part of the cylinder, among the plurality of second-directional gas supply passages may have a width larger than a width of a second second-directional gas supply passage provided at the rear part of the cylinder or the frame facing the rear part of the cylinder.

The plurality of first-directional gas supply passages may have different widths each other in the longitudinal direction of the cylinder.

A width of a front of the first-directional gas supply passage may be larger than a width of a rear of the second-directional gas supply passage.

The cylinder may include the cylinder body in a cylindrical shape and extending in the axial direction and a cylinder flange protruding outward in a radial direction from one side and coupled to the frame, the gas supply passage is provided at the cylinder body, and the second-directional gas supply passage comprises a first second-directional gas supply passage formed adjacent to the cylinder flange, a second second-directional gas supply passage spaced apart from the first second-directional gas supply passage by a predetermined distance, and a third second-directional gas supply passage spaced apart from the second second-directional gas supply passage by a predetermined distance.

The third second-directional gas supply passage may include a seating recess in which a sealing member provided between the cylinder and the frame is seated.

A foremost second-directional gas supply passage among the plurality of second-directional gas supply passages may be disposed to overlap an outlet of the gas hole.

The restrictor region may be provided to have a circular shape, an oval shape, a portion of the circular shape, and a portion of the oval shape.

In the restrictor region, an interval between the inner circumferential surface of the frame and the outer circumferential surface of the cylinder may be provided within a range of 5 to 10 micrometers.

A width of the gas supply passage may be provided larger by 10 times or more than the interval between the inner circumferential surface of the frame and the outer circumferential surface of the cylinder in the restrictor region.

A depth of the gas supply passage may be provided larger by 10 times or more than the interval between the inner circumferential surface of the frame and the outer circumferential surface of the cylinder in the restrictor region.

the frame may include a frame body having a cylindrical shape and accommodating the cylinder and a frame flange extending outward in a radial direction from a front part of the frame body and configured to allow a driving unit configured to drive the piston to be connected thereto, and the gas hole may have one side communicating with a front of the frame flange and the other side communicating with an inner side of the frame body.

The frame may further include a frame connection part configured to connect the frame body and the frame flange, the gas hole may be configured to extend from an inlet formed at the frame flange in a first direction, be bent in a direction adjacent to the cylinder, and extend in a second direction so as to be connected to an outlet formed at the frame body, and the outlet may be provided to overlap a portion of the gas supply passage.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain the principle of the disclosure. In the drawings.

DETAILED DESCRIPTION OF THE DISCLOSURE

Figure 1:
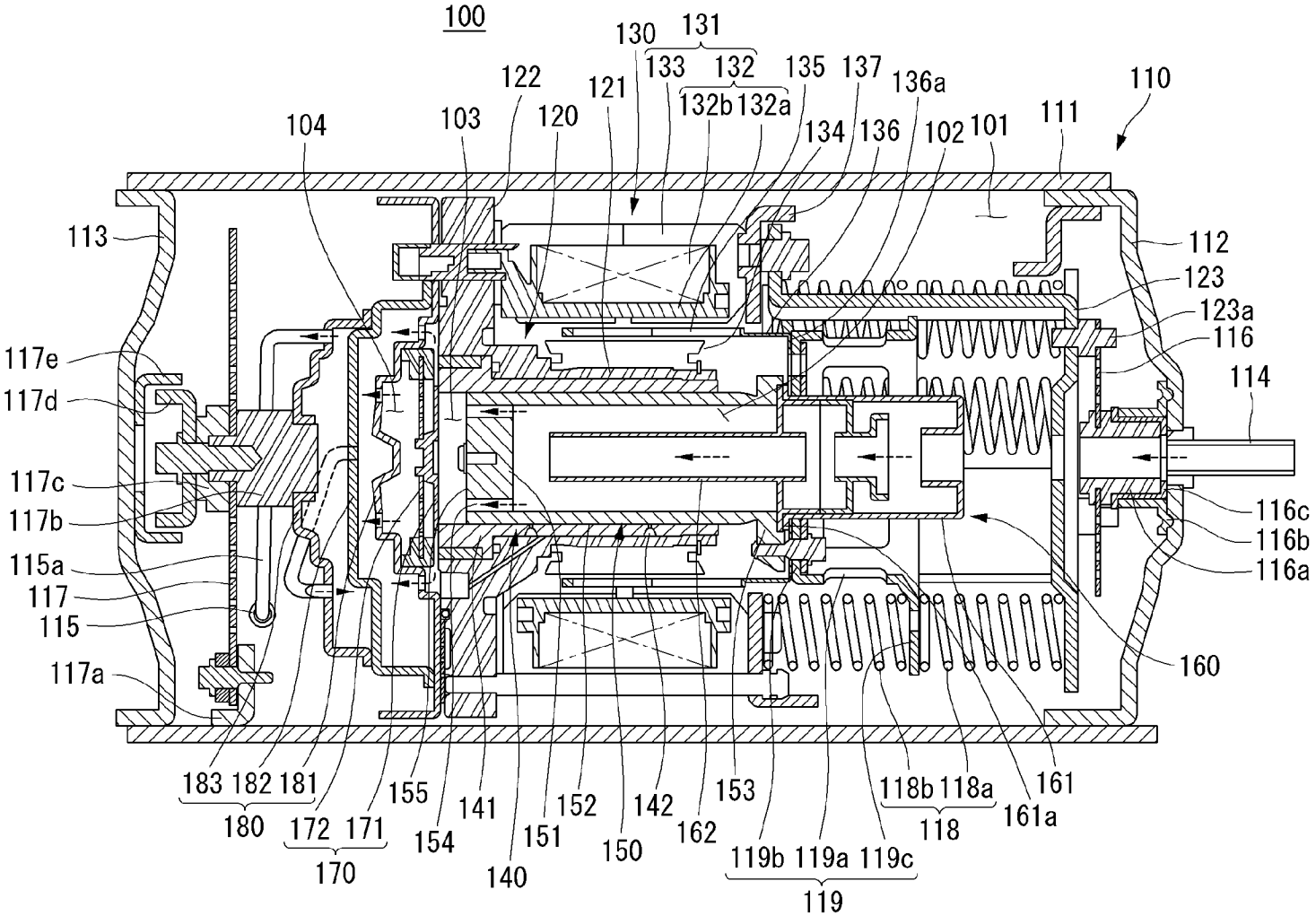
FIG. 1 is a cross-sectional view illustrating a structure of a compressor.

Hereinafter, embodiments of the present disclosure will be described specifically with reference to the accompanying drawings. In addition, like reference numerals are used to indicate like elements throughout the drawings, regardless of reference numeral, and the same descriptions on the like elements will be omitted.

In describing an embodiment of the present disclosure, it will be understood that when an element is referred to as being "connected" or "coupled" to another element, it can be directly connected or coupled to the other element or intervening elements may be present.

In describing the present disclosure, if a detailed explanation for a related known function or construction is considered to unnecessarily divert the gist of the present disclosure, such explanation has been omitted but would be understood by those skilled in the art. The accompanying drawings of the present disclosure aim to facilitate understanding of the present disclosure and should not be construed as limited to the accompanying drawings. Also, the present disclosure is not limited to a specific disclosed form, but includes all modifications, equivalents, and substitutions without departing from the scope and spirit of the present disclosure.

Meanwhile, terms of the disclosure may be replaced with terms such as document, specification, description, and the like.

FIG. 1 is a cross-sectional view illustrating a structure of a compressor 100.

Hereinafter, as a compressor according to the present disclosure, a linear compressor that sucks and compresses a fluid and discharges a compressed fluid, while a piston performs a linear reciprocating motion, will be described as an example.

The linear compressor may be a component of a refrigerating cycle, and a fluid compressed in the linear compressor may be a refrigerant circulating through the refrigerating cycle. The refrigerating cycle includes a condenser, an expansion device, and an evaporator, in addition to the compressor. Also, the linear compressor may be used as a component of a cooling system of a refrigerator, but is not limited thereto and may be widely used throughout the industry.

Referring to FIG. 1, the compressor 100 includes a casing 110 and a body accommodated in the casing 110, and the body includes a frame 120, a cylinder 140 fixed to the frame 120, a piston 150 linearly reciprocating inside the cylinder 140, a driving unit 130 fixed to the frame 120 and providing a driving force to the piston 150, and the like. Here, the cylinder 140 and the piston 150 may be referred to as compression units 140 and 150.

The compressor 100 may have a bearing unit for reducing friction between the cylinder 140 and the piston 150. The bearing unit may be an oil bearings or a gas bearing. Alternatively, a mechanical bearing may be used as a bearing unit.

The body of the compressor 100 may be elastically supported by support springs 116 and 117 installed at both inner ends of the casing 110. The support springs include a first support spring 116 supporting a rear part of the body and a second support spring 117 supporting a front part of the body, and may be provided as leaf springs. In addition, the support springs 116 and 117 may absorb vibrations and shocks that occur by a reciprocating motion of the piston 150, while supporting internal parts of the body.

The casing 110 may form a closed space, and the closed space includes an accommodating space 101 in which a sucked refrigerant is accommodated, a suction space 102 filled with a refrigerant before being compressed, and a discharge space 104 filled with a compressed refrigerant.

That is, the refrigerant sucked from the suction pipe 114 connected to the rear part of the casing 110 is filled in the accommodating space 101, and the refrigerant in the suction space 102 communicating with the accommodating space 101 is compressed in the compression space 103 and discharged to the discharge space 104, and discharged to the outside through a discharge pipe 115 connected to a front part of the casing 110.

The casing 110 may include a shell 111 opened in both ends and having a cylindrical shape elongated in a horizontal direction, a first shell cover 112 coupled to a rear part of the shell 111, and a second shell cover 113 coupled to a front part of the shell 111.

Here, the front part side is the left of the drawing and refers to a direction in which the compressed refrigerant is discharged, and the rear part side is the right of the drawing and refers to a direction in which the refrigerant is introduced. In addition, the first shell cover 112 or the second shell cover 113 may be formed integrally with the shell 111.

The casing 110 may be formed of a thermally conductive material. Through this, heat generated in an inner space of the casing 110 may be quickly dissipated to the outside.

The first shell cover 112 may be coupled to the shell 111 to seal the rear side of the shell 111, and a suction pipe 114 is inserted at the center of the first shell cover 112 and coupled.

The rear side of the compressor body may be elastically supported in a radial direction by the first shell cover 112 through the first support spring 116.

The first support spring 116 may be provided as a circular leaf spring, an edge portion thereof is supported by a back cover 123 in a forward direction through a support bracket 123*a*, and the opened central portion may be supported by the first shell cover 112 in a backward direction through a suction guide 116*a*.

The suction guide 116*a* is formed in a cylindrical shape in which a through flow path is provided. The central opening of the first support spring 116 may be coupled to a front outer circumferential surface of the suction guide 116*a*, and a rear end thereof may be supported by the first shell cover 112. In this case, a separate suction side support member 116*b* may be interposed between the suction guide 116*a* and the inner surface of the first shell cover 112.

The rear side of the suction guide 116*a* may communicate with the suction pipe 114, and the refrigerant sucked through the suction pipe 114 may smoothly flow into a muffler unit 160 to be described later through the suction guide 116*a*.

A damping member 116*c* formed of a rubber material or the like may be installed between the suction guide 116*a* and the suction side support member 116*b*. Accordingly, it is possible to block transmission of vibrations that may occur while the refrigerant is sucked through the suction pipe 114 to the first shell cover 112.

The second shell cover 113 may be coupled to the shell 111 to seal the front side of the shell 111, and the discharge pipe 115 may be inserted through a loop pipe 115*a* and coupled. The refrigerant discharged from the compression space 103 may pass through a discharge cover assembly 180 and then be discharged to the refrigerating cycle through the loop pipe 115*a* and the discharge pipe 115.

The front side of the compressor body may be elastically supported in the radial direction by the shell 111 or the second shell cover 113 through the second support spring 117.

The second support spring 117 may be provided as a circular leaf spring, the opened central portion is supported by the discharge cover assembly 180 in the rear direction through a first support guide 117*b*, and an edge portion thereof may be supported on an inner surface of the shell 111 in the radial direction by the support bracket 117*a* or on an inner circumferential surface of the shell 111 adjacent to the second shell cover 113. Alternatively, unlike the drawings, the edge portion of the second support spring 117 may be supported by the second shell cover 113 in the forward direction through a bracket (not shown).

The first support guide 117*b* may be formed in a continuous cylindrical shape having different diameters, a front side may be inserted into the central opening of the second support spring 117, and a rear side of the discharge cover assembly 180 may be inserted into the central opening. The support cover 117*c* may be coupled to the front side of the first support guide 117*b* with the second support spring 117 interposed therebetween. A cup-shaped second support guide 117*d* concave forward may be coupled to a front side of the support cover 117*c*, and a cup-shaped third support guide 117*e* which corresponds to the second support guide 117*d* and which is concave backward may be coupled to an inner side of the second shell cover 113. The second support guide 117*d* may be inserted into the third support guide 117*e* and supported in an axial direction and a radial direction. In this case, a gap may be formed between the second support guide 117*d* and the third support guide 117*e*.

The frame 120 includes a body portion 121 supporting the outer circumferential surface of the cylinder 140 and a flange portion 122 connected to one side of the body portion 121 and supporting the driving unit 130.

The frame 120 may be elastically supported by the casing 110 by the first support spring 116 and the second support spring 117 together with the driving unit 130 and the cylinder 140.

The body portion 121 may be formed in a cylindrical shape surrounding the outer circumferential surface of the cylinder 140, and the flange portion 122 may be formed to extend in the radial direction from a front end of the body portion 121.

The cylinder 140 may be coupled to the inner circumferential surface of the body portion 121, and an inner stator 134 may be coupled to the outer circumferential surface. For example, the cylinder 140 may be fixed by press fitting to the inner circumferential surface of the body portion 121 and the inner stator 134 may be fixed using a fixing ring.

An outer stator 131 may be coupled to a rear surface of the flange portion 122, and a discharge cover assembly 180 may be coupled to a front surface thereof. For example, the outer stator 131 and the discharge cover assembly 180 may be fixed through a mechanical coupling unit.

A bearing inlet recess 125*a* forming a part of the gas bearing is formed on one side of the front surface of the flange portion 122, a bearing communication hole 125*b* penetrating to the inner circumferential surface of the body portion 121 from the bearing inlet recess 125*a* is formed, and a gas recess 125*c* communicating with the bearing communication hole 125*b* may be formed on the inner circumferential surface of the body portion 121.

A bearing inlet recess 125*a* is formed to be recessed in the axial direction to a predetermined depth, and the bearing communication hole 125*b* may be formed as a hole with a cross-sectional area smaller than the bearing inlet recess 125*a* and inclined toward the inner circumferential surface of the body portion 121.

The gas recess 125*c* may be formed in an annular shape having a predetermined depth and an axial length on the inner circumferential surface of the body portion 121. Alternatively, the gas recess 125*c* may be formed on the outer circumferential surface of the cylinder 140 in contact with the inner circumferential surface of the body portion 121 or may be formed on both the inner circumferential surface of the body portion 121 and the outer circumferential surface of the cylinder 140.

In addition, a gas inlet 142 corresponding to the gas recess 125*c* may be formed on the outer circumferential surface of the cylinder 140. The gas inlet 142 forms a kind of nozzle portion in the gas bearing.

Meanwhile, the frame 120 and the cylinder 140 may be formed of aluminum or an aluminum alloy.

The cylinder 140 may be formed in a cylindrical shape in which both ends are open, the piston 150 may be inserted through a rear end of the cylinder 140, and a front end of the cylinder 140 may be closed through the discharge valve assembly 170. A compression space 103 surrounded by the cylinder 140, a front end (head portion 151) of the piston 150, and a discharge valve assembly 170 may be formed. The compression space 103 increases in volume when the piston 150 moves backward and decreases as the piston 150 moves forward. That is, the refrigerant introduced into the compression space 103 is compressed and discharged through the discharge valve assembly 170 while the piston 150 moves forward.

The cylinder 140 may have a front end bent outward to form a flange portion 141. The flange portion 141 of the cylinder 140 may be coupled to the frame 120. For example, a flange recess corresponding to the flange portion 141 of the cylinder 140 may be formed at the front end of the frame 120, and the flange portion 141 of the cylinder 140 may be inserted into the flange recess and coupled through a mechanical coupling member.

Meanwhile, the compressor 100 may include a gas bearing unit capable of lubricating gas between the cylinder 140 and the piston 150 by supplying a discharge gas to an interval between the outer circumferential surface of the piston 150 and the inner circumferential surface of the cylinder 140. The discharge gas between the cylinder 140 and the piston 150 provides a levitation force to the piston 150 to reduce friction of the piston 150 against the cylinder 140.

For example, the cylinder 140 may have a gas inlet 142 communicating with the gas recess 125*c* formed on the inner circumferential surface of the body portion 121 and guiding the compressed refrigerant introduced to the gas recess 125*c* through the cylinder 140 in the radial direction to a space between the inner circumferential surface of the cylinder 140 and the outer circumferential surface of the piston 150. Alternatively, in consideration of convenience of processing, the gas recess 125*c* may be formed on the outer circumferential surface of the cylinder 140.

The gas inlet 142 may be formed as a fine hole so that an inlet thereof is relatively larger and an outlet thereof is formed to serve as a nozzle. A filter (not shown) blocking an inflow of a foreign matter may be additionally provided at the entrance of the gas inlet 142. The filter may be a mesh filter formed of a metal or may be formed by winding a member such as Cecile.

A plurality of gas inlets 142 may be independently formed, or an inlet may be formed as an annular recess and a plurality of outlets may be formed along the annular recess at a predetermined interval.

In addition, the gas inlet 142 may be formed only on the front side based on the middle of the cylinder 140 in the axial direction or may be formed together on the rear side in consideration of sagging of the piston 150.

The piston 150 is inserted into a rear opening of the cylinder 140 and is provided to seal the rear of the compression space 103.

The piston 150 includes a head portion 151 that partitions the compression space 103 in a disk shape and a cylindrical guide portion 152 extending backward from the outer circumferential surface of the head portion 151. The head portion 151 is provided to be partially open, and the guide portion 152 is empty inside. A front part of the guide portion 152 is partially sealed by the head portion 151 and a rear part thereof is opened to be connected to the muffler unit 160. The head portion 151 may be provided as a separate member coupled to the guide portion 152, or the head portion 151 and the guide portion 152 may be integrally formed.

A suction port 154 is formed through the head portion 151 of the piston 150. The suction port 154 is provided to communicate with the suction space 102 and the compression space 103 inside the piston 150. For example, the refrigerant flowing from the accommodating space 101 to the suction space 102 inside the piston 150 may be sucked into the compression space 103 between the piston 150 and the cylinder 140 through the suction port 154.

The suction port 154 may extend in the axial direction of the piston 150. Alternatively, the suction port 154 may be formed to be inclined in the axial direction of the piston 150. For example, the suction port 154 may extend so as to be inclined in a direction away from a central axis toward the rear part of the piston 150.

The suction port 154 may have a circular cross-sectional area and a constant inner diameter. Alternatively, the suction port 154 may be formed as a long hole whose opening extends in the radial direction of the head portion 151, or may be formed such that the inner diameter increases toward the rear part.

A plurality of suction ports 154 may be formed in any one or more of a radial direction and a circumferential direction of the head portion 151.

In addition, a suction valve 155 for selectively opening and closing the suction port 154 may be mounted on the head portion 151 of the piston 150 adjacent to the compression space 103. The suction valve 155 may be operated by elastic deformation to open or close the suction port 154. That is, the suction valve 155 may be elastically deformed to open the suction port 154 by a pressure of the refrigerant flowing into the compression space 103 through the suction port 154.

In addition, the piston 150 may be connected to the mover 135, and the mover 135 reciprocates a the front-rear direction according to the movement of the piston 150. An inner stator 134 and the cylinder 140 may be located between the mover 135 and the piston 150. The mover 135 and the piston 150 may be connected to each other by a magnet frame 136 formed by bypassing the cylinder 140 and the inner stator 134 to the rear part.

The muffler unit 160 is coupled to a rear part of the piston 150 and is provided to attenuate noise that occurs while the refrigerant is sucked into the piston 150. The refrigerant sucked through the suction pipe 114 flows to the suction space 102 inside the piston 150 through the muffler unit 160.

The muffler unit 160 includes a suction muffler 161 communicating with the accommodating space 101 of the casing 110 and an internal guide 162 connected to a front part of the suction muffler 161 and guiding the refrigerant to the suction port 154.

The suction muffler 161 is located at a rear part of the piston 150, a rear opening is disposed adjacent to the suction pipe 114, and a front end may be coupled to a rear part of the piston 150. The suction muffler 161 may have a flow path formed in the axial direction to guide the refrigerant in the accommodating space 101 to the suction space 102 inside the piston 150.

In this case, a plurality of noise spaces partitioned by baffles may be formed inside the suction muffler 161. The suction muffler 161 may be formed by coupling two or more members to each other, and for example, a second suction muffler may be press-fit into the first suction muffler to form a plurality of noise spaces. In addition, the suction muffler 161 may be formed of a plastic material in consideration of weight or insulation.

The internal guide 162 may have a pipe shape having one side communicating with the noise space of the suction muffler 161 and the other side deeply inserted into the interior of the piston 150. The internal guide 162 may be formed in a cylindrical shape in which both ends are provided with the same inner diameter, but in some cases, the inner diameter of the front end on the discharge side may be formed larger than the inner diameter of the rear end on the opposite side.

The suction muffler 161 and the internal guide 162 may be provided in various shapes, through which a pressure of the refrigerant passing through the muffler unit 160 may be adjusted. The suction muffler 161 and the internal guide 162 may be integrally formed.

The discharge valve assembly 170 may include a discharge valve 171 and a valve spring 172 provided on a front side of the discharge valve 171 to elastically support the discharge valve 171. The discharge valve assembly 170 may selectively discharge the refrigerant compressed in the compression space 103. Here, the compression space 103 may be understood as a space formed between the suction valve 155 and the discharge valve 171.

The discharge valve 171 may be disposed to be supported on a front surface of the cylinder 140 and may be mounted to selectively open and close the front opening of the cylinder 140. The discharge valve 171 may be operated by elastic deformation to open or close the compression space 103. The discharge valve 171 may be elastically deformed to open the compression space 103 by a pressure of the refrigerant flowing into the discharge space 104 through the compression space 103. For example, in a state where the discharge valve 171 is supported on the front surface of the cylinder 140, the compression space 103 may be maintained in a closed state, and in a state where the discharge valve 171 is separated from the front surface of the cylinder 140, the compressed refrigerant in the compression space 103 may be discharged to the open space.

The valve spring 172 is provided between the discharge valve 171 and the discharge cover assembly 180 to provide an elastic force in the axial direction. The valve spring 172 may be provided as a compression coil spring or may be provided as a leaf spring in consideration of occupied space or reliability.

When the pressure in the compression space 103 is greater than or equal to a discharge pressure, the valve spring 172 is deformed forward to open the discharge valve 171, and the refrigerant is discharged from the compression space 103 and is discharged to the first discharge space 103*a* of the discharge cover assembly 180. When the discharge of the refrigerant is completed, the valve spring 172 provides a restoring force to the discharge valve 171 so that the discharge valve 171 is closed.

A process in which the refrigerant is introduced into the compression space 103 through the suction valve 155 and the refrigerant in the compression space 103 through the discharge valve 171 is discharged to the discharge space 104 will be described as follows.

In the process in which the piston 150 reciprocates and linearly moves inside the cylinder 140, when a pressure in the compression space 103 becomes is equal to or lower than a predetermined suction pressure, the suction valve 155 is opened and the refrigerant is sucked into the compressed space 103. Meanwhile, when the pressure in the compression space 103 exceeds the predetermined suction pressure, the refrigerant in the compression space 103 is compressed while the suction valve 155 is closed.

Meanwhile, when the pressure in the compression space 103 is equal to or higher than a predetermined discharge pressure, the valve spring 172 is deformed forward to open the discharge valve 171 connected thereto and the refrigerant is discharged from the compression space 103 to the discharge space 104 of the discharge cover assembly 180. When the discharge of the refrigerant is completed, the valve spring 172 provides a restoring force to the discharge valve 171 and the discharge valve 171 is closed to seal the front part of the compression space 103.

The discharge cover assembly 180 may be installed in front of the compression space 103 to form a discharge space 104 for accommodating the refrigerant discharged from the compression space 103 and is coupled to the front part of the frame 120 to attenuate noise that occurs while the refrigerant is discharged from the compression space 103. The discharge cover assembly 180 may be coupled to a front part of the flange portion 122 of the frame 120, while accommodating the discharge valve assembly 170. For example, the discharge cover assembly 180 may be coupled to the flange portion 122 through a mechanical coupling member.

A gasket 165 for heat insulation and an O-ring 166 for suppressing leakage of the refrigerant in the discharge space 104 may be provided between the discharge cover assembly 180 and the frame 120.

The discharge cover assembly 180 may be formed of a thermally conductive material. Accordingly, when a high-temperature refrigerant flows into the discharge cover assembly 180, heat of the refrigerant may be transferred to the casing 110 through the discharge cover assembly 180 to dissipate heat to the outside of the compressor.

The discharge cover assembly 180 may include one discharge cover or a plurality of discharge covers may be disposed to sequentially communicate with each other. When the plurality of discharge covers are provided, the discharge space 104 may include a plurality of space portions partitioned by each discharge cover. The plurality of space portions are arranged in the front-rear direction and communicate with each other.

For example, in case of three discharge covers, the discharge space 104 may include a first discharge space 103*a* formed between the first discharge cover 181 coupled to a front side of the frame 120 and the frame 120, a second discharge cover 182 communicating with the first discharge space 103*a* and coupled to a front side of the first discharge cover 181, and a third discharge cover 103*c* communicating with the second discharge space 103*b* and formed between the third discharge cover 183 coupled to a front side of the second discharge cover 182 and the second discharge cover 182.

The first discharge space 103*a* may selectively communicate with the compression space 103 by the discharge valve 171, the second discharge space 103*b* may communicate with the first discharge space 103*a*, the third discharge space 103*c* may communicate with the second discharge space 103*b*. Accordingly, the refrigerant discharged from the compression space 103 may be attenuated in discharge noise, while sequentially passing through the first discharge space 103*a*, the second discharge space 103*b*, and the third discharge space 103*c* and may be discharged to the outside of the casing 110 through the loop pipe 115*a* and the discharge pipe 115 communicating with the third discharge cover 183.

The driving unit 130 may include an outer stator 131 disposed to surround the body portion 121 of the frame 120 between the shell 111 and the frame 120, an inner stator 134 disposed to surround the cylinder 140 between the outer stator 131 and the cylinder 140, and a mover 135 disposed between the outer stator 131 and the inner stator 134.

The outer stator 131 may be coupled to a rear part of the flange portion 122 of the frame 120, and the inner stator 134 may be coupled to an outer circumferential surface of the body portion 121 of the frame 120. The inner stator 134 may be spaced apart inwardly from the outer stator 131, and the mover 135 may be disposed in a space between the outer stator 131 and the inner stator 134.

The outer stator 131 may be equipped with a winding coil, and the mover 135 may have a permanent magnet. The permanent magnet may be configured as a single magnet having one pole or may be configured by combining a plurality of magnets having three poles.

The outer stator 131 includes a coil winding body 132 surrounding the axial direction in a circumferential direction and a stator core 133 stacked while surrounding the coil winding body 132. The coil winding body 132 may include a hollow cylindrical bobbin 132*a* and a coil 132*b* wound in the circumferential direction of the bobbin 132*a*. A cross-section of the coil 132*b* may be formed in a circular or polygonal shape and may have a hexagonal shape, for example. In the stator core 133, a plurality of lamination sheets may be radially stacked, or a plurality of lamination blocks may be stacked along a circumferential direction.

The front side of the outer stator 131 may be supported by the flange portion 122 of the frame 120, and the rear side may be supported by the stator cover 137. For example, the stator cover 137 may be provided in the shape of a hollow disk, the outer stator 131 may be supported on a front surface of the stator cover 137, and a resonance spring 190 may be supported on a rear surface thereof.

The inner stator 134 may be configured by stacking a plurality of laminations on the outer circumferential surface of the body portion 121 of the frame 120 in the circumferential direction.

One side of the mover 135 may be coupled to and supported by the magnet frame 136. The magnet frame 136 has a substantially cylindrical shape and is disposed to be inserted into a space between the outer stator 131 and the inner stator 134. The magnet frame 136 is coupled to a rear side of the piston 150 and is provided to move together with the piston 150.

For example, a rear end of the magnet frame 136 is bent and extended radially inward to form a coupling portion 136*a*, and the coupling portion 136*a* may be coupled to the flange portion 153 formed at a rear part of the piston 150. The coupling portion 136*a* of the magnet frame 136 and the flange portion 153 of the piston 150 may be coupled through a mechanical coupling member.

Further, a flange portion 161*a* formed in front of the suction muffler 161 may be interposed between the flange portion 153 of the piston 150 and the coupling portion 136*a* of the magnet frame 136. Accordingly, the piston 150, the muffler unit 160, and the mover 135 may linearly reciprocate together in a state where they are integrally coupled.

When a current is applied to the driving unit 130, a magnetic flux is formed in the winding coil, and an electromagnetic force is generated by an interaction between the magnetic flux formed in the winding coil of the outer stator 131 and the magnetic flux formed by the permanent magnet of the mover 135 to cause the mover 135 to move. The piston 150 connected to the magnet frame 136 reciprocates integrally with the mover 135 at the same time as the mover 135 reciprocates in the axial direction.

Meanwhile, the driving unit 130 and the compression units 140 and 150 may be supported in the axial direction by the support springs 116 and 117 and the resonance spring 190.

The resonance spring 118 may amplify vibration implemented by the reciprocating motion of the mover 135 and the piston 150, thereby effectively compressing the refrigerant. Specifically, the resonance spring 118 may be adjusted to a frequency corresponding to a natural frequency of the piston 150 so that the piston 150 may perform a resonant motion. In addition, the resonance spring 118 may allow the piston 150 to stably move to thereby reduce vibration and noise generation.

The resonance spring 118 may be a coil spring extending in the axial direction. Both ends of the resonance spring 118 may be connected to a vibrating body and a fixed body, respectively. For example, one end of the resonance spring 118 may be connected to the magnet frame 136 and the other end may be connected to the back cover 123. Accordingly, the resonance spring 118 may be elastically deformed between the vibrating body vibrating at one end and the fixed body fixed to the other end.

The natural frequency of the resonance spring 118 may be designed to match a resonance frequency of the mover 135 and the piston 150 when the compressor 100 is operated, so that the reciprocating motion of the piston 150 may be amplified. However, since the back cover 123 provided as the fixed body is elastically supported to the casing 110 through the first support spring 116, it may not be strictly fixed.

The resonance spring 118 may include a first resonance spring 118*a* supported on the rear side based on the spring supporter 119 and a second resonance spring 118*b* supported on the front side.

The spring supporter 119 may include a body portion 119*a* surrounding the suction muffler 161, a coupling portion 119*b* bent in an inner radial direction from the front part of the body portion 119*a*, and a support portion 119*c* bent in an outward radial direction from the rear part of the body portion 119*a*.

The coupling portion 119*b* of the spring supporter 119 may have a front surface supported on the coupling portion 136*a* of the magnet frame 136. In addition, an inner diameter of the coupling portion 119*b* of the spring supporter 119 may be provided to surround an outer diameter of the suction muffler 161. For example, the coupling portion 119*b* of the spring supporter 119, the coupling portion 136*a* of the magnet frame 136, and the flange portion 153 of the piston 150 may be sequentially arranged and then integrated through a mechanical member. Here, as described above, the flange portion 161*a* of the suction muffler 161 may be interposed and fixed together between the flange portion 153 of the piston 150 and the coupling portion 136*a* of the magnet frame 136.

The first resonance spring 118*a* may be provided between a front surface of the back cover 123 and a rear surface of the spring supporter 119, and the second resonance spring 118*b* may be provided between a rear surface of the stator cover 137 and a front surface of the spring supporter 119.

The first and second resonance springs 118*a* and 118*b* may be arranged in plurality in a circumferential direction of a central axis. The first resonance spring 118*a* and the second resonance spring 118*b* may be arranged to be parallel to each other in the axial direction or may be arranged alternately each other. The first and second springs 118*a* and 118*b* may be arranged at regular intervals in the radial direction of the central axis. For example, three first and second springs 118*a* and 118*b* may be provided, respectively, and may be arranged at intervals of 120 degrees in the radial direction of the central axis.

Meanwhile, the compressor 100 may include a plurality of sealing members capable of increasing a coupling force between the frame 120 and parts around the frame 120.

For example, a plurality of sealing members may include a discharge cover sealing member interposed at a portion where the frame 120 and the discharge cover assembly 180 are coupled and inserted into an installation recess provided at a front end of the frame 120 and a cylinder sealing member provided at a portion where the frame 120 and the cylinder 140 are coupled and inserted into an installation recess provided at an outer surface of the cylinder 140.

The cylinder sealing member may prevent the refrigerant in the gas recess 125*c* formed between the inner circumferential surface of the frame 120 and the outer circumferential surface of the cylinder 140 from leaking to the outside and increase a coupling force of the frame 120 and the cylinder 140. The plurality of sealing members may further include an inner stator sealing member provided at a portion where the frame 120 and the inner stator 134 are coupled and inserted into an installation recess provided on an outer surface of the frame 120.

In addition, the sealing members may have a ring shape.

The operation of the linear compressor 100 described above is as follows.

First, when a current is applied to the driving unit 130, a magnetic flux may be formed in the outer stator 131 by the current flowing through the coil 132*b*. The magnetic flux formed in the outer stator 131 generates an electromagnetic force, and the mover 135 having a permanent magnet may linearly reciprocate by the generated electromagnetic force. This electromagnetic force may be generated alternately in a direction (forward direction) in which the piston 150 is oriented toward a top dead center (TDC) during a compression stroke and in a direction (backward direction) in which the piston 150 isoriented toward a bottom dead center (BDC) during a suction stroke. That is, the driving unit 130 may generate thrust, which is a force that pushes the mover 135 and the piston 150 in the moving direction.

The piston 150, which linearly reciprocates inside the cylinder 140, may repeatedly increase and decrease a volume of the compression space 103.

When the piston 150 moves in a direction (rear direction) to increase the volume of the compression space 103, a pressure in the compression space 103 decreases. Accordingly, the suction valve 155 mounted at a front part of the piston 150 is opened and the refrigerant remaining in the suction space 102 may be sucked into the compression space 103 along the suction port 154. This suction stroke is performed until the piston 150 maximizes the volume of the compression space 103 to reach the bottom dead center.

When reaching the bottom dead center, the piston 150 is changed in moving direction to perform a compression stroke, while moving in a direction (forward direction) to reduce the volume of the compression space 103. During the compression stroke, the sucked refrigerant is compressed as the pressure in the compression space 103 increases. When the pressure in the compression space 103 reaches a set pressure, the discharge valve 171 is pushed by the pressure in the compression space 103 and is opened from the cylinder 140, and the refrigerant is discharged through the spaced space. This compression stroke continues while the piston 150 moves to the top dead center where the volume of the compression space 103 is minimized.

As the suction stroke and the compression stroke of the piston 150 are repeated, the refrigerant introduced into the accommodating space 101 inside the compressor 100 through the suction pipe 114 flows into the suction space 102 inside the piston 150 sequentially by way of the suction guide 116*a*, the suction muffler 161, and the internal guide 162, and the refrigerant in the suction space 102 flows into the compression space inside the cylinder 140 during the suction stroke of the piston 150. After the refrigerant in the compression space 103 is compressed and discharged to the discharge space 104 during the compression stroke of the piston 150, a flow of the refrigerant discharged to the outside of the compressor 100 through the loop pipe 115*a* and the discharge pipe 115 may be formed.

Figure 2:
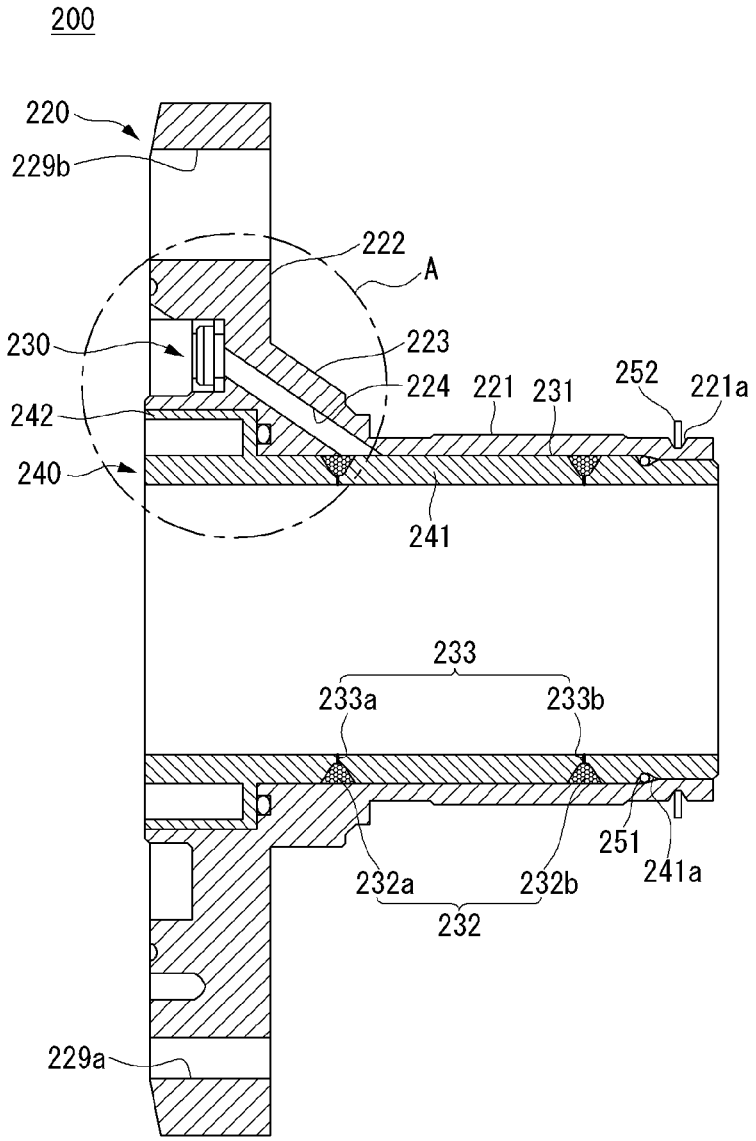
FIG. 2 is a cross-sectional view illustrating a coupling structure of a frame and a cylinder.
Figure 3:
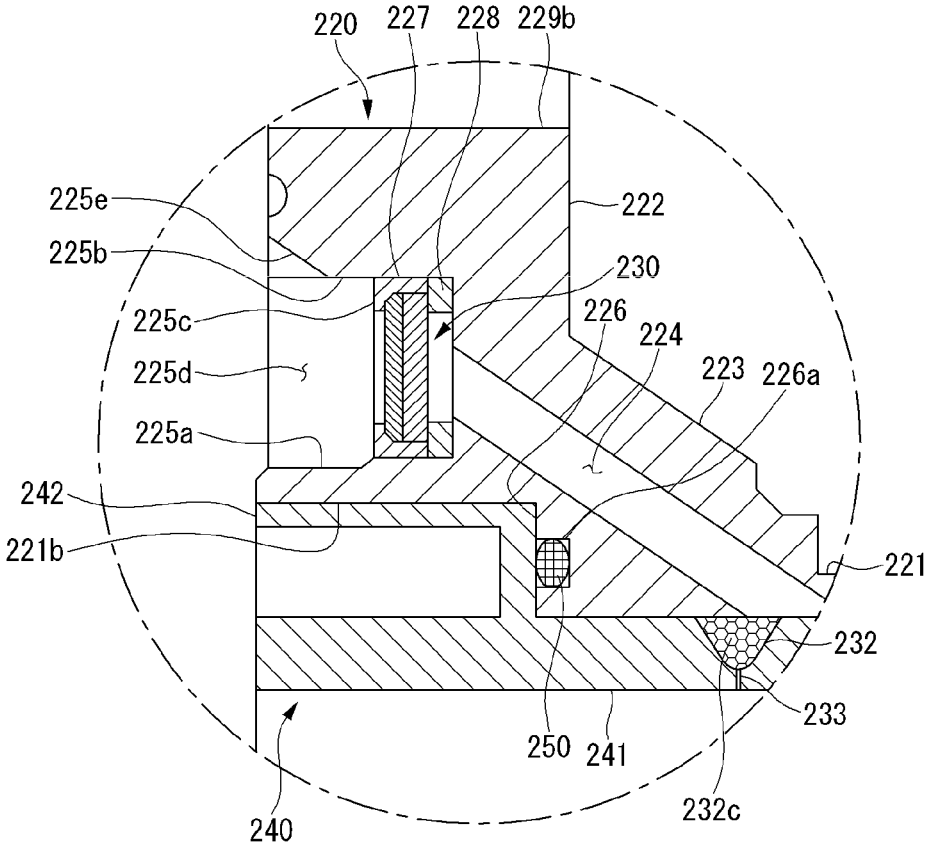
FIG. 3 is an enlarged cross-sectional view illustrating a portion A in FIG. 2.

FIG. 2 is a cross-sectional view illustrating a coupling structure of the frame 220 and the cylinder 240, and FIG. 3 is a cross-sectional view illustrating an enlarged portion A in FIG. 2.

Referring to FIGS. 2 and 3, the cylinder 240 according to an embodiment of the present disclosure may be coupled to the frame 220. For example, the cylinder 240 may be disposed to be inserted into the frame 220.

The frame 220 includes a frame body 221 extending in the axial direction and a frame flange 222 extending radially outward from the frame body 221.

In other words, the frame flange 222 may extend from the outer circumferential surface of the frame body 221 to achieve a first set angle. For example, the first set angle may be formed as about 90 degrees.

The frame body 221 is provided in a cylindrical shape having a central axis in the axial direction, and a body accommodating portion accommodating a cylinder body 241 to be described later is formed therein.

A third installation recess 221*a* into which a third sealing member 252 disposed between the inner stator (see 134 in FIG. 1) is inserted may be formed in the rear part of the frame body 221.

Referring to FIG. 3, the frame flange 222 includes a first wall 225*a* having a ring shape and coupled to the cylinder flange 242, a second wall 225*b* arranged to surround the first wall 225*a* and having a ring shape, and a third wall 225*c* connecting a rear end of the first wall 225*a* and a rear end of the second wall 225*b*. The first wall 225*a* and the second wall 225*b* may extend in the axial direction, and the third wall 225*c* may extend in the radial direction.

A frame space portion 225*d* may be defined by the first to third walls 225*a*, 225*b*, and 225*c*. In other words, the frame space portion 225*d* is recessed from a front end of the frame flange 222 toward a rear part and forms a part of a discharge flow path along which the refrigerant discharged through the discharge valve (see 171 in FIG. 1) flows.

An inner space of the first wall 225*a* includes a flange accommodating portion 221*b* into which at least a portion of the cylinder 240, e.g., the cylinder flange 242 to be described later, is inserted. For example, an inner diameter of the flange accommodating portion 221*b* may be the same as or slightly smaller than an outer diameter of the cylinder flange 242.

When the cylinder 240 is press-fit into the frame 220, the cylinder flange 242 may interfere with the first wall 225*a*, and in this process, the cylinder flange 242 may be deformed.

The frame flange 222 further includes a sealing member seating portion 226 extending radially inward from a rear end of the first wall 225*a*. A first installation recess 226*a* into which the first sealing member 250 is inserted is formed in the sealing member seating portion 226. The first installation recess 226*a* may be configured to be recessed backward from the sealing member seating portion 226.

The frame flange 222 further includes a fastening hole 229*a* to which a predetermined fastening member is coupled for fastening of the frame 220 and peripheral components. A plurality of fastening holes 229*a* may be arranged along an outer circumference of the second wall 225*b*.

The frame flange 222 may include a terminal insertion portion 229*b* that provides a lead-out path of a terminal portion of the driving unit (see 130 in FIG. 1). The terminal insertion portion 229*b* is formed such that the frame flange 222 is cut in the front-rear direction.

The terminal portion may extend forward from the coil (see 132*b* of FIG. 1) and may be inserted into the terminal insertion portion 229*b*. With this configuration, the terminal portion may be exposed to the outside from the driving unit 130 and the frame 220 and may be connected to a cable.

A plurality of terminal insertion portions 229*b* may be provided, and the plurality of terminal insertion portions 229*b* may be arranged along the outer circumference of the second wall 225*b*. Among the plurality of terminal insertion portions 229*b*, only one terminal insertion portion 229*b* into which the terminal portion is inserted is provided. The remaining terminal insertion portions 229*b* may be understood to be provided to prevent deformation of the frame 220.

For example, in the frame flange 222, three terminal insertion portions 229*b* are formed. Among them, the terminal portion may be inserted into one terminal insertion portion 229*b*, and the terminal portion may not be inserted into the remaining two terminal insertion portions 229*b*.

In the frame 220, a large amount of stress may work in the process of being fastened to the stator cover (see 137 in FIG. 1) or the discharge cover assembly (see 180 in FIG. 1) or press-fit with the cylinder 240. If only one terminal insertion portion 229*b* is formed in the frame flange 222, the stress may be concentrated on a specific point to cause deformation in the frame flange 222. Therefore, in this embodiment, the terminal insertion portion 229*b* is formed at three places of the frame flange 222, that is, evenly arranged in the circumferential direction with respect to the center of the frame 220, thereby preventing the occurrence of stress.

The frame 220 further includes a frame inclined portion 223 extending obliquely toward the frame body 221 from the frame flange 222. An outer surface of the frame inclined portion 223 may extend to form a second set angle with respect to the outer circumferential surface of the frame body 221, that is, an axial direction. For example, the second set angle may be formed as an angle value greater than 0 degrees and smaller than 90 degrees.

A gas hole 224 for guiding the refrigerant discharged from the discharge valve (see 171 in FIG. 1) to the gas inlet 232 of the cylinder 240 is formed at the frame inclined portion 223. The gas hole 224 may be formed to penetrate the inside of the frame inclined portion 223.

Specifically, the gas hole 224 may extend from the frame flange 222 and may extend to the frame body 221 via the frame inclined portion 223.

Since the gas hole 224 is formed through a portion of the frame 220 having a slightly large thickness to the frame flange 222, the frame inclined portion 223 and the frame body 221, the frame 220 may be prevented from being weakened due to the formation of the gas hole 224.

An extending direction of the gas hole 224 may form the second set angle with respect to the inner circumferential surface of the frame body 221, that is, the axial direction, to correspond to the extending direction of the frame inclined portion 223.

At the inlet of the gas hole 224, a discharge filter 230 for filtering foreign matter of the refrigerant to be introduced into the gas hole 224 may be disposed. The discharge filter 230 may be installed on the third wall 225*c*.

Specifically, the discharge filter 230 is installed at a filter recess 227 formed in the frame flange 222. The filter recess 227 is configured to be recessed backward from the third wall 225*c* and may have a shape corresponding to a shape of the discharge filter 230.

In other words, an inlet of the gas hole 224 is connected to the filter recess 227, and the gas hole 224 may extend to the inner circumferential surface of the frame body 221 through the frame flange 222 and the frame inclined portion 223 from the filter recess 227.

In addition, a guide recess 225*e* facilitating processing of the gas hole 224 may be formed at the frame flange 222. The guide recess 225*e* is formed such that at least a portion of the second wall 225*b* is recessed, and may be located at an edge of the filter recess 227.

In the process of machining the gas hole 224, a machining mechanism may be drilled from the filter recess 227 toward the frame inclined portion 223. In this case, the machining mechanism may be interfered with the second wall 225*b*, and thus drilling may not be easily performed. Accordingly, in the present embodiment, a guide recess 225*e* may be formed at the second wall 225*b*, so that the machining mechanism is located at the guide recess 225*e* to facilitate machining of the gas hole 224.

The linear compressor 100 further includes a filter sealing member 228 installed at a rear part of the discharge filter 230, that is, at an outlet side. The filter sealing member 228 may have an approximately ring shape. Specifically, the filter sealing member 228 may be placed in the filter recess 227 and may be press-fit to the filter recess 227, while the discharge filter 230 presses the filter recess 227.

Meanwhile, the frame inclined portion 223 may be provided in plurality along the circumference of the frame body 221. Among the plurality of frame inclined portions 223, only one frame inclined portion 223 in which the gas hole 224 is formed is provided. The remaining frame inclined portions 223 may be understood to be provided to prevent deformation of the frame 220.

In the frame 220, a lot of stress may act in the process of being fastened with the stator cover 149 or the discharge cover 160 or being press-fitted with the cylinder 240. If only one frame inclined portion 223 is formed in the frame 220, the stress may be concentrated on a specific point to deform the frame 220. Accordingly, in this embodiment, the frame inclined portion 223 is formed at three positions outside the frame body 221, that is, in the circumferential direction with respect to the center of the frame 220, thereby preventing the occurrence of concentration of the stress.

The cylinder 240 is coupled to the inside of the frame 220. For example, the cylinder 240 may be coupled to the frame 220 by a press-fitting process.

The cylinder 240 includes a cylinder body 241 extending in the axial direction and a cylinder flange 242 provided outside a front portion of the cylinder body 241.

The cylinder body 241 is provided in a cylindrical shape having a central axis in the axial direction and is inserted into the frame body 221. Thus, the outer circumferential surface of the cylinder body 241 may be located to face the inner circumferential surface of the frame body 221.

In the cylinder body 241, a gas inlet 232 through which the gas refrigerant flowing through the gas hole 224 is introduced is formed.

The linear compressor 200 further includes a gas pocket 231 formed between the inner circumferential surface of the frame 220 and the outer circumferential surface of the cylinder 240, through which a gas flows for a lubrication function.

The refrigerant gas flow path from the outlet of the gas hole 224 to the gas inlet 232 forms at least a portion of the gas pocket 231. The gas inlet 232 may be disposed on the inlet side of a nozzle portion 233 to be described later.

Specifically, the gas inlet 232 may be configured to be recessed radially inward from the outer circumferential surface of the cylinder body 241. The gas inlet 232 may be configured to have a circular shape along the outer circumferential surface of the cylinder body 241 with respect to the central axis in the axial direction.

The gas inlet 232 may be provided in plurality. For example, two gas inlets 232 may be provided. Among the two gas inlets 232, a first gas inlet 232*a* is disposed at a position close to a front portion of the cylinder body 241, that is, a discharge valve (see 171 in FIG. 1), and a second gas inlet 232*b* is disposed at a rear portion of the cylinder body 241, that is, a position close to a compressor suction side of the refrigerant. In other words, the first gas inlet 232*a* may be located on the front side with respect to the center of the cylinder body 241 in the front-rear direction, and the second gas inlet 232*b* may be located on the rear side.

The first nozzle portion 233*a* connected to the first gas inlet 232*a* is located on the front side with respect to the center, and the second nozzle portion 233*b* connected to the second gas inlet 232*b* may be located at the rear side based on the center.

Specifically, the first gas inlet 232*a* or the first nozzle portion 233*a* is formed at a position spaced apart from the front end of the cylinder body 241 by a first distance. The second gas inlet 232*b* or the second nozzle portion 233*b* is formed at a position spaced apart from the front end of the cylinder body 241 by a second distance.

The second distance may have a value greater than the first distance.

The third distance from the front end of the cylinder body 241 to the center may be larger than the first distance and smaller than the second distance.

In addition, a fourth distance from the center to the first gas inlet 232*a* or the first nozzle portion 233*a* may be determined as a value smaller than a fifth distance from the center to the second gas inlet 232*b* or the second nozzle portion 233*b*.

Meanwhile, the first gas inlet 232*a* is formed at a position adjacent to the outlet of the gas hole 224. In other words, a distance from the outlet of the gas hole 224 to the first gas inlet 232*a* may be smaller than a distance from the outlet to the second gas inlet 232*b*. For example, the outlet of the gas hole 224 and the first gas inlet 232*a* may be disposed to partially overlap each other.

Since an internal pressure of the cylinder 240 is formed relatively high at a position close to the discharge side of the refrigerant, that is, inside the first gas inlet 232*a*, the outlet of the gas hole 224 is located adjacent to the first gas inlet 232*a* so that a relatively large amount of refrigerant may be introduced into the cylinder 240 through the first gas inlet 232*a*. As a result, a function of the gas bearing may be strengthened to prevent abrasion of the cylinder 240 and the piston 150 during the reciprocating motion of the piston 150.

A cylinder filter member 232*c* may be installed at the gas inlet 232. The cylinder filter member 232*c* blocks foreign matter having a predetermined size or greater from flowing into the cylinder 240 and absorbs oil contained in the refrigerant. Here, the predetermined size may be 1 μm.

The cylinder filter member 232*c* includes a thread wound around the gas inlet 232. Specifically, the thread may be formed of polyethylene terephthalate (PET) material and have a predetermined thickness or diameter.

The thickness or diameter of the thread may be determined to be an appropriate value in consideration of a strength of the thread. If the thickness or diameter of the thread is too small, the strength of the thread may be too weak and easily cut. If the thickness or diameter of the thread is too large, a gap in the gas inlet 232 when the thread is wound may be too large and a filtering effect of foreign matter may be lowered.

The cylinder body 241 includes a nozzle portion 233 extending radially inward from the gas inlet 232. The nozzle portion 233 may extend to an inner circumferential surface of the cylinder body 241.

A radial length of the nozzle portion 233 may be formed smaller than a radial length of the gas inlet 232, that is, a recessed depth. A size of an inner space of the nozzle portion 233 may be smaller than a size of the inner space of the gas inlet 232.

Specifically, the depressed depth and width of the gas inlet 232 and the length of the nozzle portion 233 may be determined to have an appropriate size in consideration of rigidity of the cylinder 240, the amount of the cylinder filter member 232*c*, or a size of a pressure drop of the refrigerant passing through the nozzle portion 233.

For example, if the depressed depth and width of the gas inlet 232 is too large or if the length of the nozzle portion 233 is too small, the rigidity of the cylinder 240 may be weakened. Meanwhile, if the depressed depth and width of the gas inlet 232 are too small, the amount of the cylinder filter member 232*c* that may be installed in the gas inlet 232 may be too small. In addition, if the length of the nozzle portion 233 is too large, the pressure drop of the refrigerant passing through the nozzle portion 233 may become too large, so that a sufficient function as a gas bearing cannot be performed.

In this embodiment, a ratio of the length of the nozzle portion 233 to the length of the gas inlet 232 is proposed in the range of 0.65 to 0.75. Within the range of the ratio, the effect of the gas bearing is improved and the rigidity of the cylinder 240 may be maintained at a required level.

In addition, the diameter of the inlet of the nozzle portion 233 may be formed larger than the diameter of the outlet. Based on the flow direction of the refrigerant, a cross-sectional area of a flow in the nozzle portion 233 is gradually reduced from the inlet to the outlet.

Here, the inlet may be understood as a portion connected to the gas inlet 232 to introduce the refrigerant into the nozzle portion 233, the outlet may be understood as a portion connected to the inner circumferential surface of the cylinder 240 to supply the refrigerant to the outer circumferential surface of the piston 150.

Specifically, when the diameter of the nozzle portion 233 is too large, the amount of the refrigerant flowing into the nozzle portion 233 among the high-pressure gas refrigerant discharged through the discharge valve 171 is too large, thereby increasing flow loss of the compressor. Meanwhile, if the diameter of the nozzle portion 233 is too small, the pressure drop in the nozzle portion 233 increases, thereby reducing the performance as a gas bearing.

Accordingly, in this embodiment, the pressure drop of the refrigerant flowing into the nozzle portion 233 may be reduced by forming the diameter of the inlet of the nozzle portion 233 to be relatively large, and the inflow amount of the gas bearing through the nozzle portion 233 may be adjusted to a predetermined value or less by forming the diameter of the outlet to be relatively small.

As an example, in this embodiment, the ratio of the diameter of the inlet to the diameter of the outlet of the nozzle portion 233 is determined to be a value of 4 to 5. Within the range of this ratio, an improvement in the effect of the gas bearing may be expected.

The nozzle portion 233 may include a first nozzle portion 233*a* extending from the first gas inlet 232*a* to the inner circumferential surface of the cylinder body 241 and a second nozzle portion 233*b* extending from the gas inlet 232*b* to the inner circumferential surface of the cylinder body 241.

The refrigerant filtered by the cylinder filter member 232*c* while passing through the first gas inlet 232*a* flows into the space between the inner circumferential surface of the cylinder body 241 and the outer circumferential surface of the piston body 150 through the first nozzle portion 233*a*. Also, the refrigerant filtered by the cylinder filter member 232*c* while passing through the second gas inlet 232*b* flows into the space between the inner circumferential surface of the cylinder body 241 and the outer circumferential surface of the piston body 150 through the second nozzle portion 233*b*.

The gas refrigerant flowing toward the outer circumferential surface of the piston body 150 through the first and second nozzle portions 233*a* and 233*b* provides a levitation force to the piston 150 to perform a function of a gas bearing with respect to the piston 150.

Since the first sealing member 250 seals the space on the front side of the gas pocket 231, leakage of the refrigerant flowing through the gas pocket 231 to the front side of the frame 220 and the cylinder 240 may be prevented. Also, since the second sealing member 251 seals the space on the rear side of the gas pocket 231, leakage of the refrigerant flowing through the gas pocket 231 to the rear side of the frame 220 and the cylinder 240 may be prevented. Thus, the performance of the gas bearing may be improved.

A second installation recess 241*a* into which a third sealing member 252 disposed between the frame body 221 is inserted may be formed at the rear portion of the cylinder body 241.

In the case of the embodiment of the present disclosure, a gas bearing unit may be used as described above. The gas bearing unit may gas-lubricate the cylinder 240 and the piston 150 by supplying a discharge gas to the gap between the outer circumferential surface of the piston 150 and the inner circumferential surface of the cylinder 240. The discharge gas between the cylinder 240 and the piston 150 provides a levitation force to the piston 150 to reduce friction of the piston 150 against the cylinder 240.

Hereinafter, the space between the cylinder 240 and the piston 150, that is, a space filled with the discharge gas supplied to provide a levitation force will be referred to as a sliding part.

Figure 4:
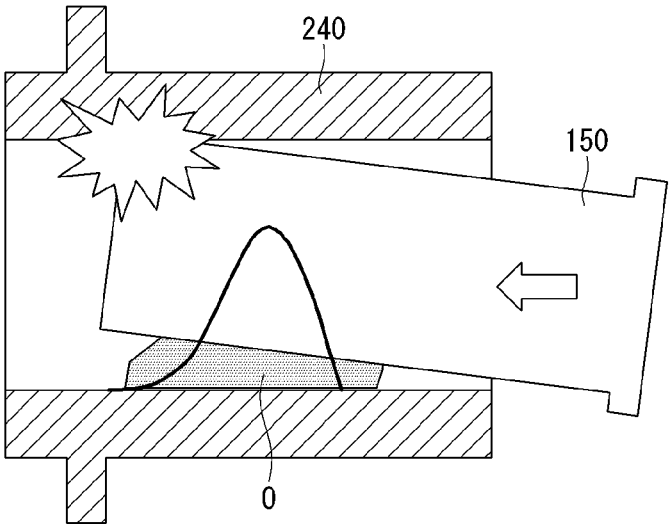
FIG. 4 is a view illustrating a phenomenon that may occur when oil is introduced into a sliding part.
Figure 4:
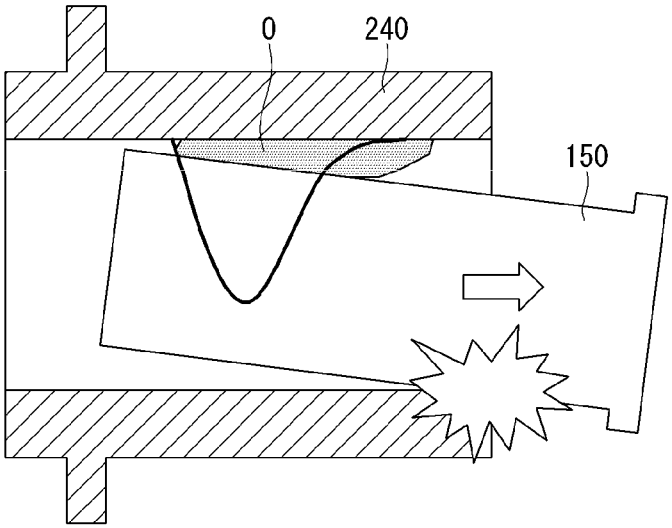
Figure 5:
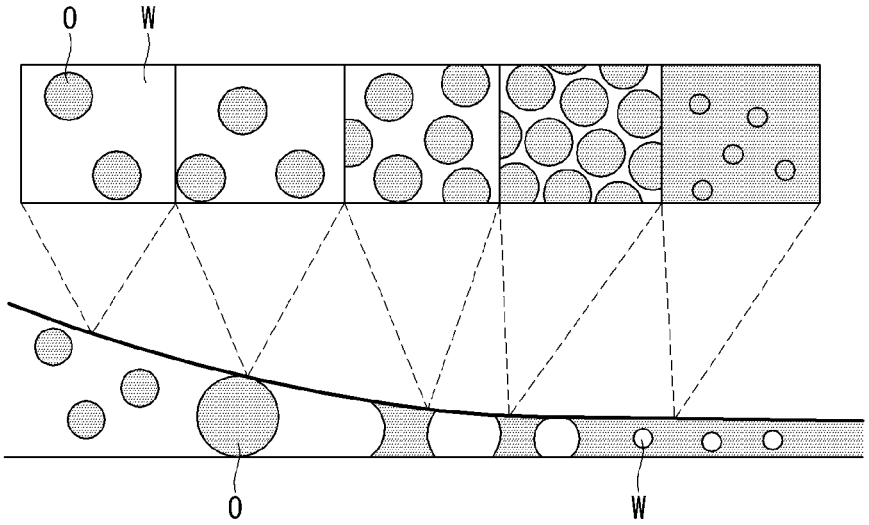
FIG. 5 is a schematic view illustrating a behavior of oil penetrating a gap.

FIG. 4 is a view illustrating a phenomenon that may occur when oil is introduced into a sliding part, and FIG. 5 is a schematic view illustrating a behavior in which oil penetrates a gap.

When oil flows into the sliding part, the lubricating performance of the discharge gas may be rapidly reduced. This is because the introduced oil generates a high dynamic pressure in the sliding part and acts as an airbag, so that the piston 150 may be pushed to one side to cause contact with the inner wall of the cylinder 240. This may cause wear and breakage of the piston 150.

In this way, a plurality of sealing members are installed in the coupling structure to prevent oil from flowing into the sliding part. However, in order to use the gas bearing unit, a gas inlet 232 for introducing a refrigerant gas into the sliding part is required, and oil inflow through the gas inlet 232 should be blocked.

The gas inlet 232 is equipped with the discharge filter 230 for blocking foreign matter, but it is difficult to filter out oil dissolved in the refrigerant due to a limitation of the specification of the discharge filter 230. The refrigerant is sucked in a gaseous state through a suction pipe, but the refrigerant may be phase-changed into a liquid state partially at a part of high pressure and low temperature in the compressor 200 and the surrounding oil may be dissolved in the phase-changed refrigerant. For example, even if a discharge filter 230 having the highest specification is mounted, oil dissolved in the r600a refrigerant cannot be filtered out.

The oil dissolved in the refrigerant may generate a mass of oil between the frame 220 and the cylinder 240, and the generated oil may flow into the sliding part to cause a problem. For reference, since oil has a very small surface tension than water, if oil comes into contact with a solid surface, oil may easily pass even through a relatively narrow gap because a contact angle is very small.

Referring to (a) of FIG. 4, when oil (o) occurs at a lower part of the sliding part, the oil (o) acts as an airbag during a compression stroke of the piston 150 to generate a force for lifting up the front of the piston 150, and a front upper portion of the piston 150 comes into contact with a front upper portion of the inner wall of the cylinder 240.

Referring to (b) of FIG. 4, when the oil (o) occurs at an upper part of the sliding part, the oil (o) acts as an airbag during a suction stroke of the piston 150 to generate a force for pushing down the rear of the piston 150, and a rear lower portion of the piston 150 comes into contact with a rear lower portion of the inner wall of the cylinder 240.

Referring to FIG. 5, it can be seen that when the oil (o) is mixed with moisture (w), the oil (o) may penetrate into a narrow gap. This is possible because oil (o) has a very small surface tension than water (w). Fine oil droplets (o) gather and grow near the narrow gap, and the oil droplets (o) with small surface tension are sucked into the narrow gap due to a pressure difference. The penetrated oil (o) fills the narrow gap with the moisture (w) in the state of microdrops.

Figure 6:
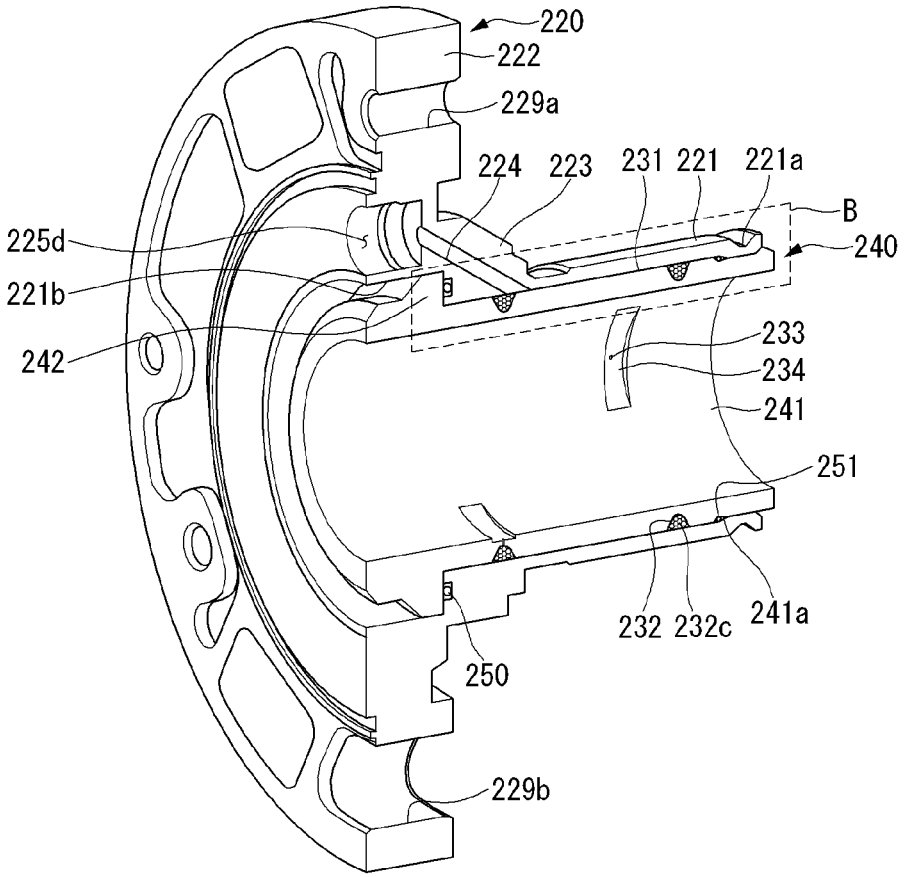
FIG. 6 is a perspective view illustrating a cylinder coupling structure of a compressor according to a first embodiment.
Figure 7:
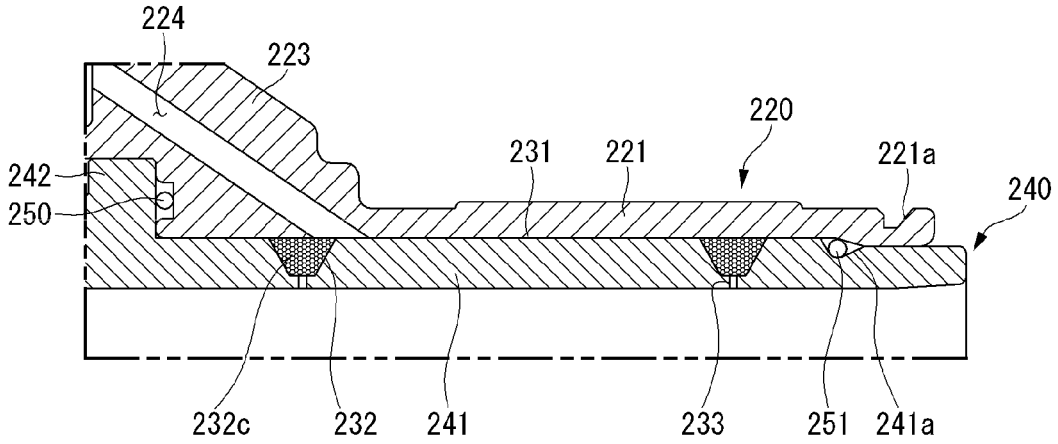
FIG. 7 is an enlarged cross-sectional view illustrating a portion B in FIG. 6.
Figure 8:
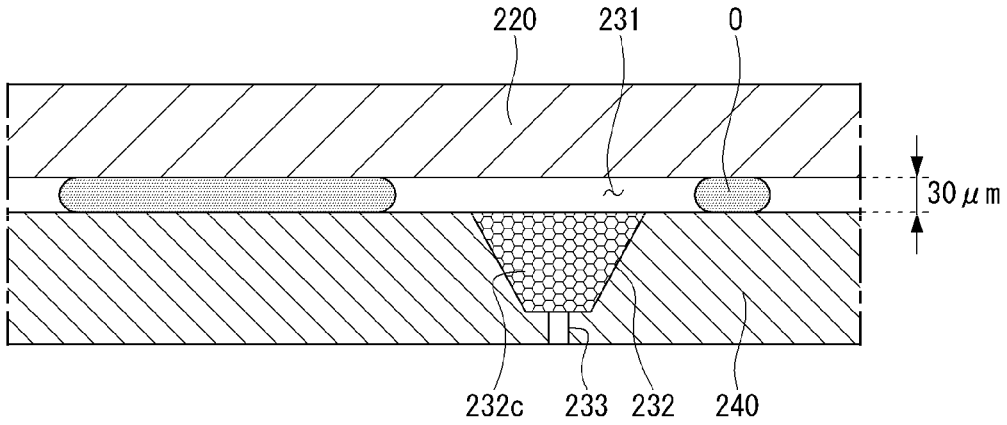
FIG. 8 is a view illustrating a phenomenon in which oil does not move into a cylinder due to friction.

FIG. 6 is a perspective view illustrating a coupling structure of the cylinder 240 of the compressor according to A first embodiment, and FIG. 7 is a cross-sectional view illustrating an enlarged portion B in FIG. 6. FIG. 8 is a view illustrating a phenomenon in which oil does not move to the inside of the cylinder due to friction.

Referring to FIGS. 6 and 7, the compressor according to an embodiment of the present disclosure is recessed radially inward from the outer circumferential surface of the cylinder body 241, and the gas inlet 232 extending in a circular shape along the outer circumferential surface is formed.

At least a part of an upper portion of the gas inlet 232 communicates with the gas hole 224 and may be provided with a lubricating gas through the gas hole 224.

The inner circumferential surface of the cylinder body 241 may have a gas accommodating recess 234 concave so as to extend by a predetermined angle in the circumferential direction.

A plurality of gas accommodating recesses 234 may be provided in the circumferential direction, and the plurality of gas accommodating recesses 234 may be arranged and spaced apart at equal intervals. For example, the gas accommodating recess 234 is concave to extend by an angle between about 15 degrees to 45 degrees in the circumferential direction, and three gas accommodating recesses 234 may be arranged and spaced apart from each other at equal intervals at an angle of 120 degrees in the circumferential direction.

The gas accommodating recess 234 may include a first gas accommodating recess 234*a* located at a front part of the cylinder body 241 and a second gas accommodating recess 234*b* located at a rear part of the cylinder body 241.

In other words, it may be understood that the first gas accommodating recess 234*a* is formed at the front part of the cylinder body 241 in which the first gas inlet 232*a* is formed, and the second gas accommodating recess 234*b* is formed at the rear part of the cylinder body 241 in which the second gas inlet 232*b* is formed.

The first gas accommodating recess 234*a* and the second gas accommodating recess 234*b* may be arranged in a stagger manner. For example, the first gas accommodating recess 234*a* located at the front part of the cylinder body 241 may be disposed to stagger at an angle of 60 degrees with the second gas accommodating recess 234*b* located at the rear part of the cylinder body 241.

In addition, the first gas accommodating recess 234*a* and the second gas accommodating recess 234*b* may be disposed not to overlap each other in a direction parallel to the axial direction.

The gas accommodating recess 234 may be formed at a position facing the gas inlet 232. That is, the gas accommodating recess 234 is disposed close to the gas inlet 232 and may be disposed on an inner surface of the circumference formed by the gas inlet 232.

The gas accommodating recess 234 may communicate with the gas inlet 232 through the nozzle portion 233. For example, the nozzle portion 233 may be formed in the shape of a hole that penetrates radially at the center of the gas accommodating recess 234 and communicates with the gas inlet 232.

The nozzle portion 233 is usually machined to a diameter of several tens of micrometers. However, during a repeated use period of the compressor, oil which has penetrated into the gas inlet 232 accumulates in the nozzle portion 233, causing frequent clogging. In this way, when oil is deposited on the nozzle portion 233, surface adhesion is applied, and thus, oil does not escape even by a pressure applied during the compression stroke of the piston 150.

The compressor 200 according to the embodiment of the present disclosure may prevent oil from being deposited in the nozzle portion 233 by forming the gas accommodating recess 234. This is because, if the outlet of the nozzle portion 233 is in direct contact with or is very close to the piston 150, the likelihood of clogging is increased due to the accumulation of oil of the nozzle portion 233.

A depth of the gas accommodating recess 234 may be continuously changed in the circumferential direction.

For example, a concave surface of the gas accommodating recess 234 may form a curvature greater than a curvature of the inner circumferential surface of the cylinder body 241. In this case, the nozzle portion 233 communicates with the deepest part of the gas accommodating recess 234, and a space between the piston 150 and the nozzle portion 233 may be secured. As the depth of the gas accommodating recess 234 continuously decreases along the circumference of the piston 150, it may be easy for the refrigerant gas supplied through the nozzle portion 233 to be spread between the piston 150 and the cylinder body 241.

In addition, in the compressor 200 according to an embodiment of the present disclosure, penetrated oil may be prevented from moving and collected into the gas pocket 231 by narrowing an interval (radial thickness) of the gas pocket 231 serving as a flow path of the refrigerant gas between the frame 220 and the cylinder 240.

The gas pocket 231 may have a cylindrical strip shape formed in the space between the inner circumferential surface of the frame body 221 and the outer circumferential surface of the cylinder body 241, and both ends thereof are sealed with sealing members 250 and 251.

For example, a front end of the gas pocket 231 may be sealed with a first sealing member 250, and a rear end may be sealed with a second sealing member 251.

Usually, in the compressor using the gas bearing unit, the interval of the gas pocket 231 is provided within 150 micrometers. As such, it is possible to facilitate an assembly process by providing a margin corresponding to the assembly tolerance.

In the embodiment of the present disclosure, the interval of the gas pocket 231 is in the range of 10 to 30 micrometers. That is, the gap (tolerance) between the inner circumferential surface of the frame body 221 and the outer circumferential surface of the cylinder 240 is provided in the range of 10 to 30 micrometers.

Referring to FIG. 8, when the interval of the gas pocket 231 is 30 micrometers or less, the oil (o) is prevented from flowing into the gas inlet 232 by a surface friction force of the gas pocket 231. The surface friction force of the oil increases as the interval of the gas pocket 231 decreases, and this is related to compression of the oil (o) as the interval of the gas pocket 231 decreases. That is, when the interval of the gas pocket 231 is 30 micrometers, a magnitude of the friction force of the oil (o) and stress applied to the oil (o) are the same or the friction force becomes larger.

In addition, the oil (o) collected in the interval of the gas pocket 231 may be expected to serve as a filter to catch foreign matter moving to the sliding part.

When the interval of the gas pocket 231 is 10 micrometers or greater, the pressure drop at the gas inlet 232 region is a level of 0.35 bar, satisfying a lubrication performance criterion.

In this way, the structure that prevents oil from penetrating into the sliding part by reducing the assembly tolerance between the cylinder 240 and the frame 220 does not add a specific part or add a machining process, which, thus, is a method of improving reliability without increasing cost.

Figure 9:
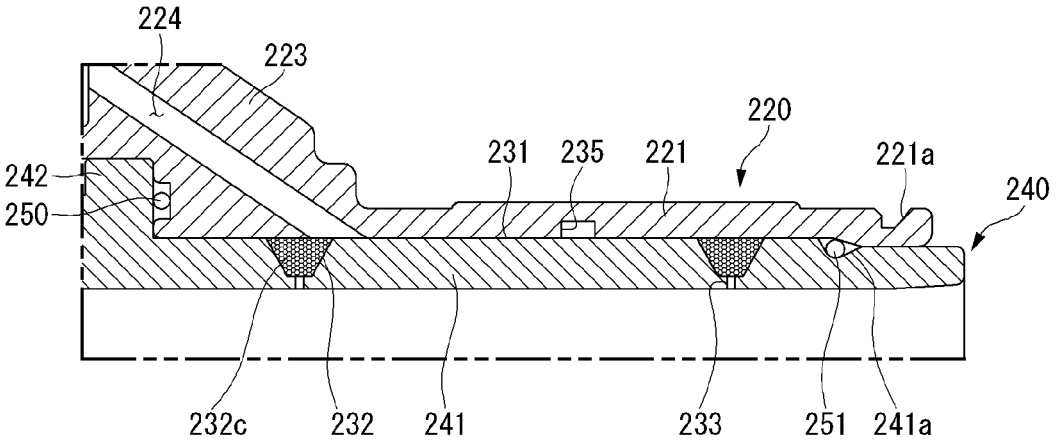
FIG. 9 is a cross-sectional view illustrating a modification of FIG. 7.

FIG. 9 is a cross-sectional view illustrating a modification of FIG. 7.

Referring to FIG. 9, a collecting recess 235 may be formed on the inner circumferential surface of the frame body 221 to collect oil or foreign matter at the gap of the gas pocket 231.

The collecting recess 235 may be formed to be recessed radially outward from the inner circumferential surface of the frame body 221.

In addition, the collecting recess 235 may be formed to extend in the circumferential direction. For example, the collecting recess 235 may be formed to extend 360 degrees in a circular shape or a plurality of collecting recesses 235 may be spaced apart from each other in a circumferential direction.

The collecting recess 235 may be formed on the inner circumferential surface of the frame body 221 or may be formed on the outer circumferential surface of the cylinder body 241. However, in order to prevent deformation of the cylinder 240, the collecting recess 235 may be desirable to be formed on the inner circumferential surface of the frame body 221.

Since the collecting recess 235 has a relatively larger depth than the gap interval of the gas pocket 231, the oil or foreign matter collected in the collecting recess 235 does not flow into the gas pocket 231 again but remain in the collecting recess 235.

Figure 10:
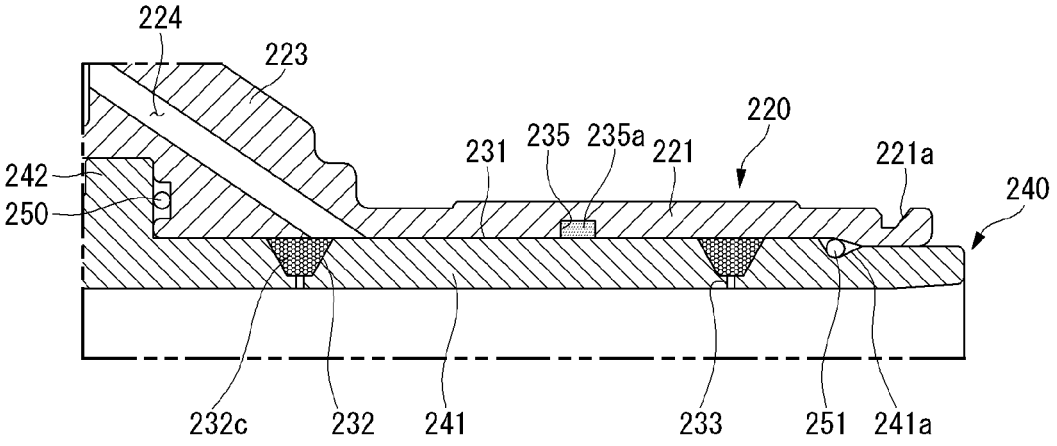
FIG. 10 is a cross-sectional view illustrating another modification of FIG. 7.

FIG. 10 is a cross-sectional view illustrating another modification of FIG. 7.

Referring to FIG. 10, a porous material 235*a* capable of absorbing oil or foreign matter may be inserted into the collecting recess 235. The porous material 235*a* may be provided in a shape corresponding to the shape of the collecting recess 235.

For example, when the collecting recess 235 extends 360 degrees in the circumferential direction, the porous material 235*a* may be provided in a ring shape.

The porous material 235*a* may be designed to minimize flow resistance of the refrigerant gas while absorbing oil or foreign matter. For example, pores may be formed in the porous material 235*a* so that only particles having a diameter of 5 micrometers or less may pass through.

Figure 11:
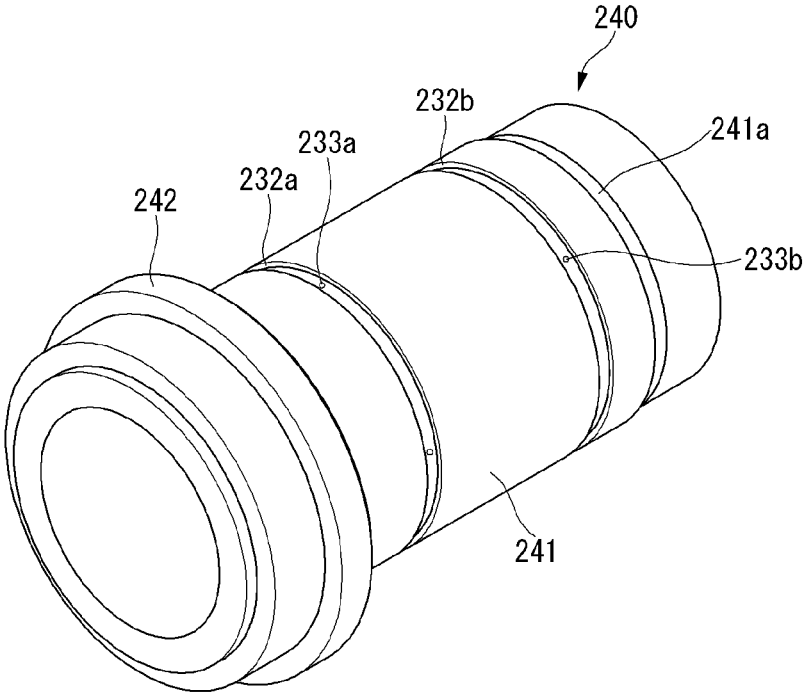
FIG. 11 is a perspective view illustrating a cylinder according to a comparative embodiment.

FIG. 11 is a perspective view illustrating a cylinder 240 according to a comparative embodiment.

The cylinder 240 may form a gas inlet 232 (232*a*, 232*b*) which is a passage through which the refrigerant gas provided from the gas hole 224 of the frame 220 passes. The gas inlet 232 may be a recess formed to be recessed radially inward from the outer circumferential surface of the cylinder 240 and extending in the circumferential direction. The gas inlet 232 includes a first gas inlet 232*a* located at a front part of the cylinder 240 and a second gas inlet 232*b* located at a rear part of the cylinder 240.

The first gas inlet 232*a* and the second gas inlet 232*b* may communicate with each other through the gas pocket 231 formed between the cylinder 240 and the frame 220.

In addition, the cylinder 240 may include a nozzle portion 233 (233*a*, 233*b*) penetrating the gas inlet 232 in the radial direction, and the nozzle portion 233 may be provided in plurality in the circumferential direction. The first gas inlet 232 may include a plurality of first nozzle portions 233*a*, and the second gas inlet may include a plurality of second nozzle portions 233*b*.

Specifically, the first gas inlet 232*a* and the first nozzle portion 233*a* are formed at positions spaced apart by a first distance from the front end of the cylinder body 241, and the second gas inlet 232*b* and the second nozzle portion 233*b* are formed at positions spaced apart from the front end of the cylinder body 241 by a second distance greater than the first distance. In addition, a third distance from the front end of the cylinder body 241 to the center may be larger than the first distance and smaller than the second distance.

Meanwhile, the first gas inlet 232*a* is formed at a position adjacent to the outlet of the gas hole 224. For example, the outlet of the gas hole 224 and the first gas inlet 232*a* may be disposed to partially overlap each other.

Since an internal pressure of the cylinder 240 is formed relatively high at a position close to the discharge side of the refrigerant, that is, inside the first gas inlet 232*a*, the outlet of the gas hole 224 is located adjacent to the first gas inlet 232*a* so that a relatively large amount of refrigerant may be introduced into the cylinder 240 through the first gas inlet 232*a*. As a result, a function of the gas bearing may be strengthened to prevent abrasion of the cylinder 240 and the piston 150 during the reciprocating motion of the piston 150.

In addition, referring to FIG. 7, the cylinder filter member 232*c* may be installed at the gas inlet 232. The cylinder filter member 232*c* blocks foreign matter having a predetermined size or greater from flowing into the cylinder body 241 and absorbs oil contained in the refrigerant. Here, the predetermined size may be 1 μm.

The cylinder filter member 232*c* may be a thread filter 232*c* provided in the shape of a thread wound 30 to 70 times with a constant tension in the gas inlet 232. Specifically, the thread filter 232*c* may be formed of polyethylene terephthalate (PET) or polytetrafluoroethylene (PTFE) and have a predetermined thickness or diameter.

The thread filter 232*c* serves as a filter to block fine dirt and oil contained in the refrigerant gas. In addition, the thread filter 232*c* also functions as a restrictor (flow restrictor) for reducing pressure of the refrigerant gas introduced from the gas bearing system.

However, the thread filter 232*c* has several problems.

The thread filter 232*c* may be fixed to the surface of the cylinder body 241 after winding a thread around the cylinder body 241 and then heat-fusing a portion of the surface, and here, the heat-fused part is damaged and tension decreases when the compressor 100 is coupled or as time elapses depending on an operating environment. If the tension of the thread filter 232*c* decreases, not only the filter function but also the restrictor function may be weakened, degrading the performance of the gas bearing.

In addition, the thread filter 232*c* is fastened by winding a thread around the cylinder body 241 by applying a tension to the recessed gas inlet 232, and here, the cylinder body 241 may be deformed, and for this reason, the performance of the gas bearing may be degraded.

Figure 12:
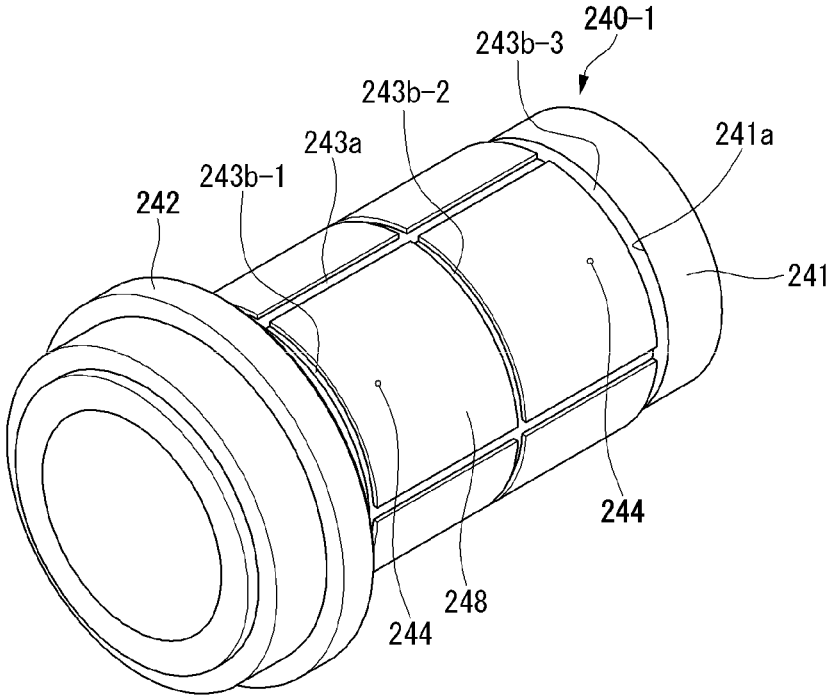
FIG. 12 is a perspective view illustrating a cylinder according to a second embodiment.
Figure 13:
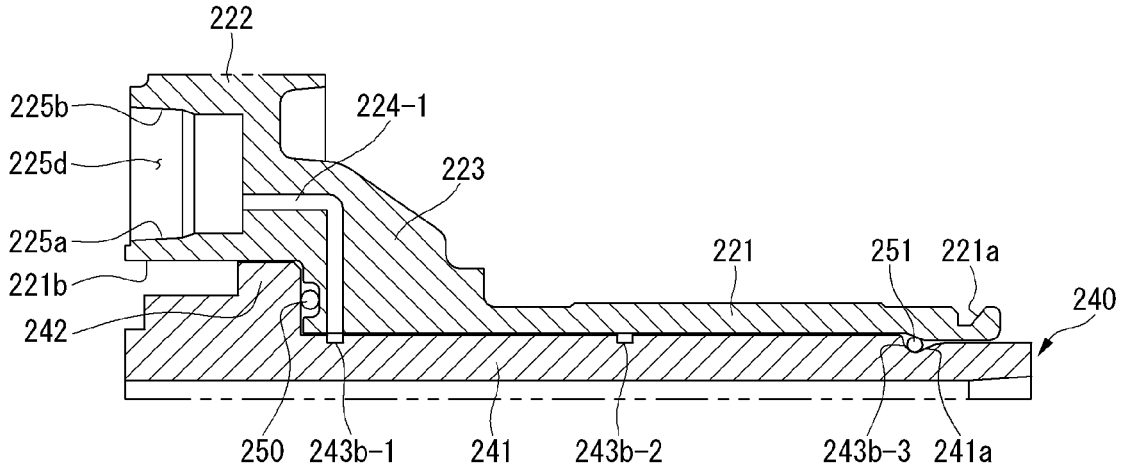
FIG. 13 is a cross-sectional view illustrating a cylinder coupling structure of a compressor according to the second embodiment.

FIG. 12 is a perspective view illustrating the cylinder 240 according to a second embodiment, and FIG. 13 is a cross-sectional view illustrating a coupling structure of the cylinder 240 of the compressor 200 according to the second embodiment.

Referring to FIGS. 12 and 13, the cylinder 240 according to the second embodiment of the present disclosure includes a gas supply passage 243 recessed from the outer circumferential surface of the cylinder body 241, and the gas supply passage 243 communicates with a gas hole 224-1 formed at the frame 220.

The gas hole 224-1 may be formed on the frame slope 223 as described above.

The gas supply passage 243 may form a part of the gas pocket 231 defined as an interval between the cylinder body 241 and the frame body 221.

Figure 14:
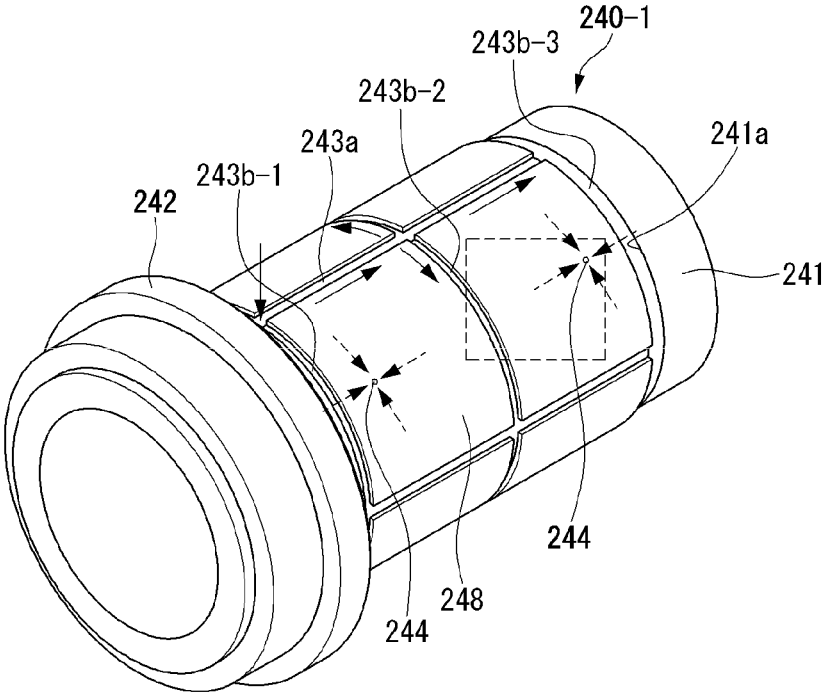
FIG. 14 is a view illustrating a flow of a refrigerant in FIG. 12.

Comparing FIG. 14 and FIG. 2, the gas hole 224 of FIG. 2 extends in an inclined direction along the frame inclined portion 223 from the frame flange 222 and is connected to the inner circumferential surface of the frame body 221. That is, the gas hole 224 provides the refrigerant gas into the frame body 221 through an inclined passage.

However, the gas hole 224-1 of FIG. 14 extends parallel to the axial direction from the frame flange 222, is bent inward from a point past the rear end of the cylinder flange 242, and extends perpendicular to the axial direction so as to be connected to the inner circumferential surface of the frame body 221. That is, the gas hole 224-1 supplies the refrigerant gas to the inside of the frame body 221 through the bent passage.

In other words, the gas hole 224-1 may include a first portion extending in parallel in the axial direction from the frame flange 222 and a second portion connected to the first portion, bent in a direction crossing the first portion, and extending to the inner circumferential surface of the frame body 221.

The second portion may communicate with the gas pocket 231. That is, the refrigerant gas flows into the gas pocket 231 between the frame body 221 and the cylinder body 241 through the first and second portions of the gas hole 224-1.

A point at which the first portion and the second portion are connected may be located behind the rear end of the cylinder flange 242.

For example, an angle formed by the first portion and the second portion may be 90 degrees.

Compared to the inclined gas hole 224 of FIG. 2, fluid resistance increases at the bent portion of the bent gas hole 224-1 of FIG. 14, so that a flow velocity may be relatively reduced.

The refrigerant gas may be supplied to a position adjacent to the front part of the cylinder body 241 through the bent passage of the gas hole 224-1, as compared to the inclined gas hole 224.

In addition, the gas supply passage 243 has a first-directional gas supply passage 243*a* extending in a longitudinal direction of the cylinder body 241 and a second-directional gas supply passage 243*b* extending in the circumferential direction of the cylinder body 241.

The first-directional gas supply passage 243*a* and the second-directional gas supply passage 243*b* are provided to cross each other, a restrictor region 248 partitioned by the first-directional gas supply passage 243*a* and the second-directional gas supply passage 243*b* may be formed.

That is, the restrictor region 248 may be formed to be surrounded by the first-directional gas supply passage 243*a* and the second-directional gas supply passage 243*b*.

The first-directional gas supply passage 243*a* extends in a direction parallel to the axial direction, and a plurality of first-directional gas supply passages 243*a* may be provided. The plurality of first-directional gas supply passages 243*a* may be spaced apart from each other at equal intervals along the circumferential direction of the cylinder body 241.

For example, four first-directional gas supply passages 243*a* may be formed at 90 degree intervals along the circumference of the cylinder body 241.

The second-directional gas supply passage 243*b* extends in the circumferential direction and may be provided in plurality. The plurality of second-directional gas supply passages 243*b* may be spaced apart from each other at equal intervals along the longitudinal direction of the cylinder body 241.

For example, the second-directional gas supply passage 243*b* may include a second-directional first gas supply passage 243*b*-1 and a second-directional second gas supply passage 243*b*-2 formed at a front part of the cylinder body 241.

In addition, the second-directional gas supply passage 243*b* may further include a second-directional third gas supply passage 243*b*-3 formed at a rear part of the cylinder body 241.

The second-directional third gas supply passage 243*b*-3 may be understood as a front space of the second sealing member 251 at the second installation recess 241*a* in which the second sealing member 251 is seated.

The second-directional first gas supply passage 243*b*-1 may be located to partially overlap the gas hole 224-1. Accordingly, the refrigerant gas flowing through the gas hole 224-1 may be directly introduced into the second-directional first gas supply passage 243*b*-1.

A grid-shaped restrictor region 248 formed as the first-directional gas supply passage 243*a* and the second-directional gas supply passage 243*b* cross each other may be provided on the outer circumferential surface of the cylinder body 241.

In the drawing, it is illustrated that two restrictor regions 248 are formed in the longitudinal direction of the cylinder 240 and four restrictor regions 248 are formed in the circumferential direction, totaling eight restrictor regions 248, and each of the restrictor regions 248 is provided with a gas intake hole 244 communicating with the inside of the cylinder 240.

Each of the restrictor regions 248 may have the same area. Alternatively, a width of the restrictor region 248 at the front part of the cylinder 240 and a width of the restrictor region 248 at the rear part of the cylinder 240 may be different.

A front side of the first-directional gas supply passage 243*a* starts from the second-directional first gas supply passage 243*b*-1, and a rear side of the first-directional gas supply passage 243*a* may extend to the second installation recess 241*a* by passing by the second-directional second gas supply passage 243*b*-2. As described above, the second installation recess 241*a* may serve as the second-directional third gas supply passage 243*b*-3.

The gas intake hole 244 penetrating the cylinder body 241 may be formed inside the restrictor region 248 partitioned by the first-directional gas supply passage 243*a* and the second-directional gas supply passage 243*b*.

For example, the gas intake hole 244 may have a circular cross-section, a diameter of the gas intake hole 244 is 35 micrometers, and eight gas intake holes may be provided on the surface of the cylinder body 241.

The gas intake hole 244 may be located so that distances to the first-directional gas supply passages 243*a* on both sides adjacent thereto are the same. That is, the gas intake hole 244 may be formed at a middle point between the first-directional gas supply passages 243*a* on both sides adjacent thereto.

In addition, the gas intake hole 244 may be located so that a distance to the second-directional gas supply passage 243*b* at the front part and a distance to the second-directional gas supply passage 243*b* at the rear are different from each other.

For example, the gas intake hole 244 between the second-directional first gas supply passage 243*b*-1 and the second-directional second gas supply passage 243*b*-2 may be located to be closer to the second-directional first gas supply passage 243*b*-1, and the gas intake hole 244 between the second-directional second gas supply passage 243*b*-2 and the second-directional third gas supply passage 243*b*-3 may be located to be closer to the second-directional third gas supply passage 243*b*-3.

FIG. 14 is a view illustrating a flow of a refrigerant in FIG. 12.

Referring to FIG. 14, the refrigerant gas flowing through the gas hole 224-1 is accommodated in the gas pocket 231, but is primarily spread through the gas supply passage 243 having a small flow resistance, and the refrigerant gas filled in the gas supply passage 243 is secondarily spread along the gap between the cylinder body 241 and the frame body 221 and flows into the gas intake hole 244. The refrigerant gas introduced into the gas intake hole 244 fills the space between the cylinder 240 and the piston and performs a bearing function.

Figure 15:
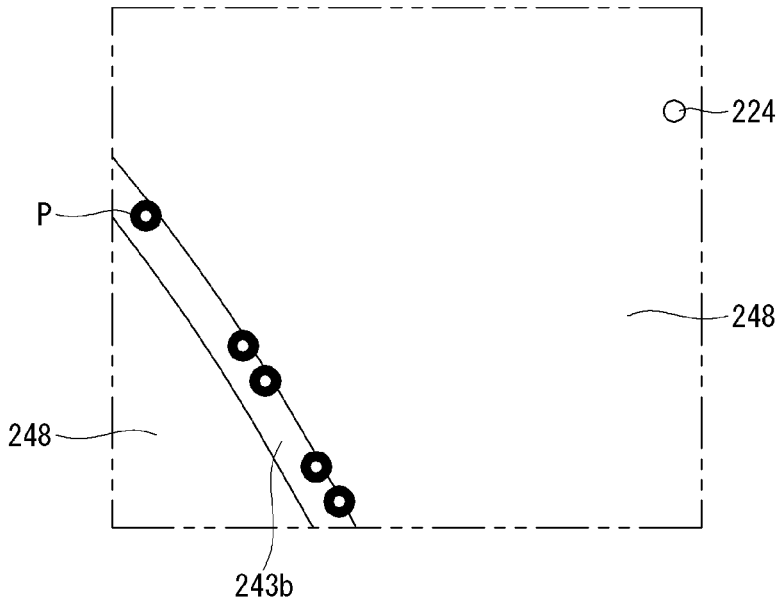
FIG. 15 is an enlarged view of a portion C in FIG. 13.

FIG. 15 is an enlarged view illustrating a portion C in FIG. 13.

Referring to FIG. 15, impurities (such as dirt and oil) introduced through the gas hole 224-1 may pass through the gas supply passage 243 having a relatively wide flow path space. However, since the impurities are prevented from flowing into the gap between the cylinder body 241 and the frame body 221 of the restrictor region 248 having a relatively narrow flow path space, whereby the filter function may be performed without having a separate filter. Therefore, when the refrigerant in the gas supply passage 243 flows into the gas intake hole 244, the refrigerant without impurities may flow in.

Specifically, the gas supply passage 243 is provided with a size of 0.1 mm or greater in width, and an interval between the cylinder body 241 and the frame body 221 is provided with a size of 10 micrometers or less. Under the size condition, movement of impurities from the gas supply passage 243 to the gas intake hole 244 may be blocked.

In addition, a distance between the outer circumferential surface of the cylinder body 241 and the inner circumferential surface of the frame body 221, that is, the interval (gap) of the gas pocket 231 may be in the range of 5 to 30 micrometers. Preferably, the interval may be in the range of 5 to 10 micrometers.

The gas supply passage 243 may be provided to have a width and depth of 0.1 mm or greater. It was confirmed that no pressure drop occurred while the refrigerant gas passed through the gas supply passage 243 when the width and depth of the gas supply passage 243 satisfy 0.1 mm.

A pressure drop does not occur while the refrigerant gas passes through the gas supply passage 243 having a width and depth of 0.1 mm or greater, and the pressure drop occurs when the refrigerant gas passes through the restrictor region 248 in which the interval between the gas intake hole 244 is 10 micrometers or less in the gas supply passage 243. Accordingly, the gas supply passage 243 serves to transfer the refrigerant having the same pressure to the restrictor region 248 divided by the gas supply passage 243 on the outer circumference of the cylinder body 241, and the gas pocket 231 between the gas intake hole 244 in the gas supply passage 243 may serve as a restrictor lowering the pressure of the refrigerant and thus may be referred to as the restrictor region 248.

Since the area of the restrictor region 248 partitioned by the gas supply passage 243 is the same, flow resistance of the refrigerant in the gap between the frame and the cylinder 240 extending to each gas intake hole 244 is the same. Accordingly, the same refrigerant flow rate may pass through each gas intake hole 244 under the same pressure condition.

In addition, the flow resistance may be varied by changing the area of the restrictor region 248 partitioned by the gas supply passage 243 and the size of the gap between the cylinder 240 and the frame extending to each gas intake hole 244 according to a position of each gas intake hole 244. Therefore, a refrigerant flow rate of each gas intake hole 244 may be different under the same pressure condition.

Figure 16:
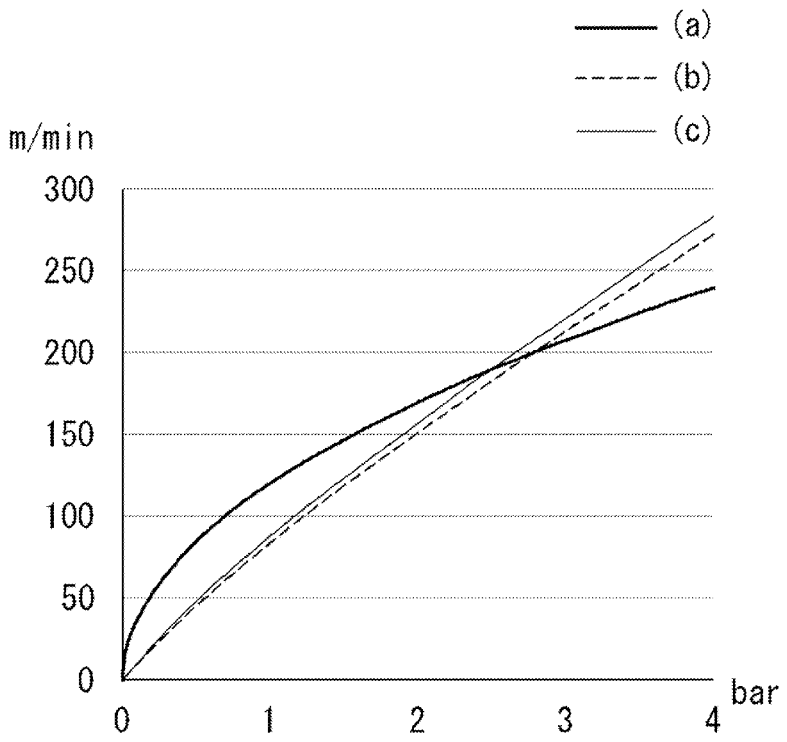
FIG. 16 is a graph showing a difference in flow rate when a width of a gas supply passage is varied.
Figure 17:
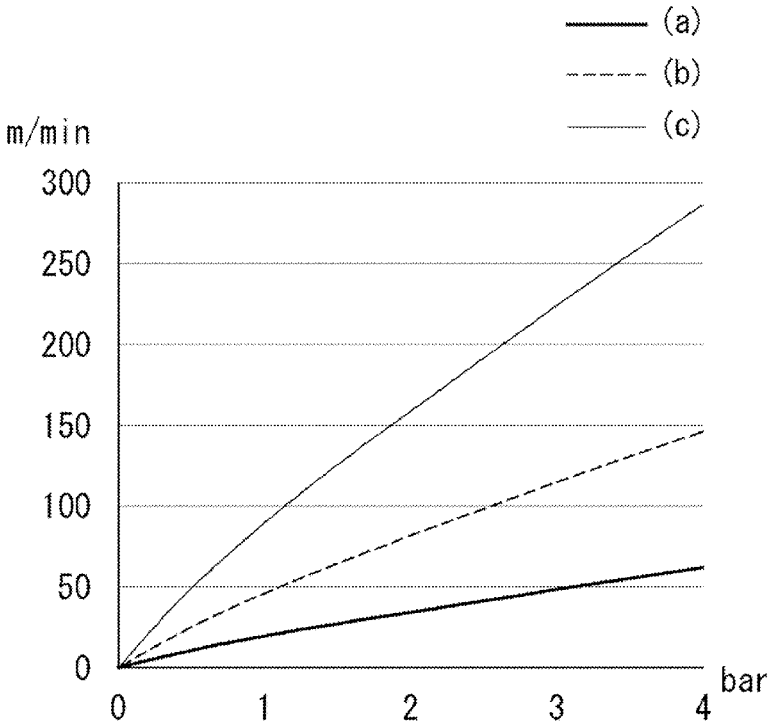
FIG. 17 is a graph showing a difference in flow rate when a gap between a frame and a cylinder is varied.

Meanwhile, the reason why the size of the gas supply passage 243 and the size of the gap between the frame and the cylinder 240 are set will be described based on FIGS. 16 and 17. FIGS. 16 and 17 show that numerical analysis was performed while changing the size of the gap between the frame and the cylinder 240 and the width of the gas supply passage 243, and the applicability of the present disclosure was confirmed through an analysis result.

FIG. 16 is a graph showing a difference in flow rate when the width of the gas supply passage 243 is varied.

(a) of FIG. 16 shows a case of the comparative embodiment shown in FIG. 11 and shows a flow rate of a single unit of the cylinder 240 when a diameter of a nozzle portion is 35 micrometers and 8 is provided in the cylinder body 241. Referring to the graph, it can be seen that, as supply air pressure increases, a fluid resistance increases and an increase rate of a flow rate decreases.

(b) of FIG. 16 shows a flow rate of a single unit of the cylinder 240 when width and depth of the gas supply passage 243 are 1 mm and the gap of the gas pocket 231 is 5 micrometers. Referring to the graph, it can be seen that a rate of increase of the flow rate is constant even when the supply air pressure increases.

(c) of FIG. 16 shows a flow rate of a single unit of the cylinder 240 when the width and depth of the gas supply passage 243 are 3 mm and the interval of the gas pockets 231 is 5 micrometers. Referring to the graph, it can be seen that the rate of increase of the flow rate is constant even when the supply air pressure increases.

From the above results, it can be seen that pressure drop does not occur when the width and depth of the gas supply passage 243 are 1 mm or greater. Meanwhile, maximum values of the width and depth of the gas supply passage 243 may be determined in consideration of rigidity of the cylinder body 241. This is because, when the width and depth of the gas supply passage 243 are increased, the flow rate of the refrigerant gas may increase but the rigidity of the cylinder body 241 may decrease.

FIG. 17 is a graph showing a difference in flow rate when the gap between the frame and the cylinder 240 is varied.

(a) of FIG. 17 shows a flow rate of a single unit of the cylinder 240 when the width and depth of the gas supply passage 243 is 3 mm and the interval of the gas pocket 231 is 5 micrometers, which is the same as (c) of FIG. 16. Referring to the graph, it can be seen that the rate of increase of the flow rate is constant even when the supply air pressure increases.

(b) of FIG. 17 shows a flow rate of a single unit of the cylinder 240 when the width and depth of the gas supply passage 243 are 3 mm and the interval of the gas pocket 231 is 4 micrometers. Referring to the graph, it can be seen that the rate of increase of the flow rate is constant even when the supply air pressure increases but the rate of increase of the flow rate decreases with the increase of pressure.

(c) of FIG. 17 shows a flow rate of a single unit of the cylinder 240 when the width and depth of the gas supply passage 243 are 3 mm and the interval of the gas pocket 231 is 3 micrometers. Referring to the graph, it can be seen that the rate of increase of the flow rate is constant even when the supply air pressure increases but the rate of increase of the flow rate decreases further with the increase of the pressure.

From the above results, it can be seen that, when the width and depth of the gas supply passage 243 are 3 mm, the increase in the flow rate according to the pressure increase is smooth when the interval of the gas pockets 231 is 5 micrometers.

Meanwhile, when the interval of the gas pocket 231 is 30 micrometers or less, oil may not flow into the gas intake hole 244 due to a surface friction force of the gas pocket 231.

That is, the interval of the gas pocket may be provided within a range of 5 to 30 micrometers.

Figure 18:
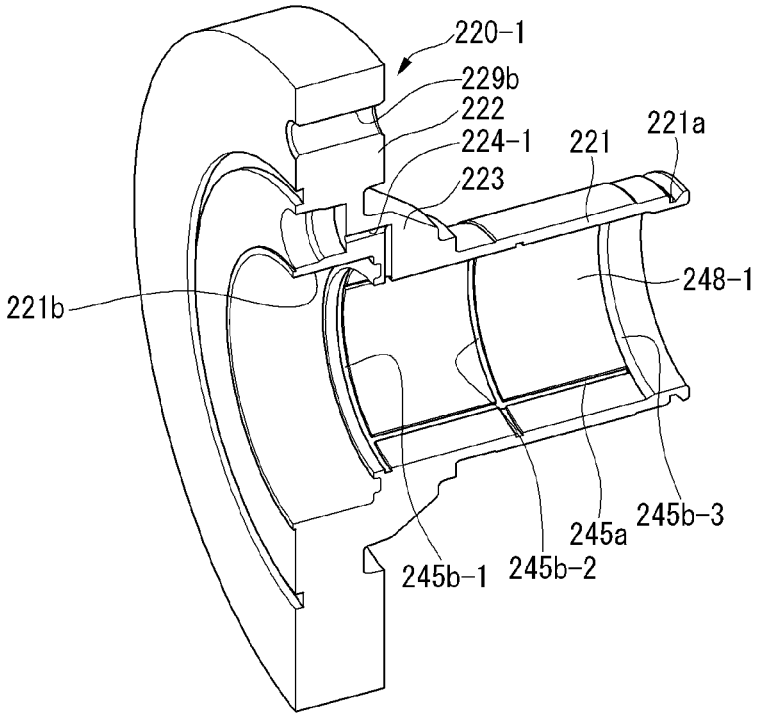
FIG. 18 is a perspective view illustrating a cross-section of a frame to describe a gas supply passage according to a second embodiment.

FIG. 18 is a perspective view illustrating a cross-section of the frame 220-1 to describe a gas supply passage 245 according to a second embodiment.

Referring to FIG. 18, the gas supply passage 245 according to the second embodiment may be formed on the inner circumferential surface of the frame body 221 rather than on the outer circumferential surface of the cylinder body 241.

The gas supply passage 245 communicates with the gas hole 224-1 formed at the frame inclined portion 223. The gas supply passage 245 may form a part of the gas pocket 231 partitioned by the interval between the cylinder body 241 and the piston body.

The gas supply passage 245 may include a first-directional gas supply passage **245*a* extending in a longitudinal direction of the frame body 221 and a second-directional gas supply passage 245*b* extending in a circumferential direction of the frame body 221**.

The first-directional gas supply passage **245*a* and the second-directional gas supply passage 245*b*** may be provided to cross each other.

In addition, a restrictor region 248-1 partitioned by the first-directional gas supply passage **245*a* and the second-directional gas supply passage 245*b*** may be formed.

The first-directional gas supply passage **245*a* may extend in a direction parallel to the axial direction and may be provided in plurality. The plurality of first-directional gas supply passages 245*a* may be spaced apart from each other at equal intervals along the circumferential direction of the frame body 221**.

For example, four first-directional gas supply passages **245*a* may be formed at 90 degree intervals along the circumference of the frame body 221**.

The second-directional gas supply passage **245*b* may extend in the circumferential direction and may be provided in plurality. The plurality of second-directional gas supply passages 245***b* may be spaced apart from each other at equal intervals along the longitudinal direction of the frame body 221.

For example, the second-directional gas supply passage 245*b* may include a second-directional first gas supply passage 245*b*-1 and a second-directional second gas supply passage 245*b*-2 formed at a front part of the frame body 221.

In addition, the second-directional gas supply passage 245*b* may further include a second-directional third gas supply passage 245*b*-3 formed at a rear part of the frame body 221.

The second-directional third gas supply passage 245*b*-3 may be understood as a front space of the second sealing member 251 in a recess in which the second sealing member 251 is seated.

The second-directional first gas supply passage 245*b*-1 may be located to directly communicate with the gas hole 224-1. Accordingly, the refrigerant gas flowing through the gas hole 224-1 may be directly introduced into the second-directional first gas supply passage 245*b*-1.

A grid-shaped restrictor region 248-1 formed as the first-directional gas supply passage 245*a* and the second-directional gas supply passage 245*b* cross each other may be formed on the outer circumferential surface of the frame body 221.

According to the above example, 4 four restrictor regions are formed in the circumferential direction and two restrictor regions are formed in the longitudinal direction, totaling 8 grid-shaped restrictor regions 248-1.

A front side of the first-directional gas supply passage 245*a* starts from the second-directional first gas supply passage 245*b*-1, and a rear side of the first-directional gas supply passage 245*a* may extend to a recess in which the second sealing member 251 is seated by passing by the second-directional second gas supply passage 245*b*-2. As described above, the recess in which the second sealing member 251 is seated may serve as the second-directional third gas supply passage 245*b*-3.

The gas intake hole 244 may be formed at the cylinder body 241 corresponding to the restrictor region 248-1.

In a state where the frame 220-1 and the cylinder 240 are coupled, the gas intake hole 244 may be located so that distances to the first-directional gas supply passages 245*a* on both sides adjacent thereto are the same. That is, the gas intake hole 244 may be formed at a middle point between the first-directional gas supply passages 245*a* on both sides adjacent thereto.

In addition, the gas intake hole 244 may be located so that a distance to the second-directional gas supply passage 245*b* at the front part and a distance to the second-directional gas supply passage 245*b* at the rear are different from each other.

For example, the gas intake hole 244 between the second-directional first gas supply passage 245*b*-1 and the second-directional second gas supply passage 245*b*-2 may be located to be closer to the second-directional first gas supply passage 245*b*-1, and the gas intake hole 244 between the second-directional second gas supply passage 245*b*-2 and the second-directional third gas supply passage 245*b*-3 may be located to be closer to the second-directional third gas supply passage 245*b*-3.

Meanwhile, the gas supply passages 243 and 245 may be formed only on the outer circumferential surface of the cylinder body 241, only on the inner circumferential surface of the frame body 221, on both the outer circumferential surface of the cylinder body 241 and the inner circumferential surface of the frame body 221.

In the latter case, the gas supply passage 243 formed on the outer circumferential surface of the cylinder body 241 and the gas supply passage 245 formed on the inner circumferential surface of the frame body 221 may be formed at positions facing each other or may be formed at positions alternated with each other.

Figure 19:
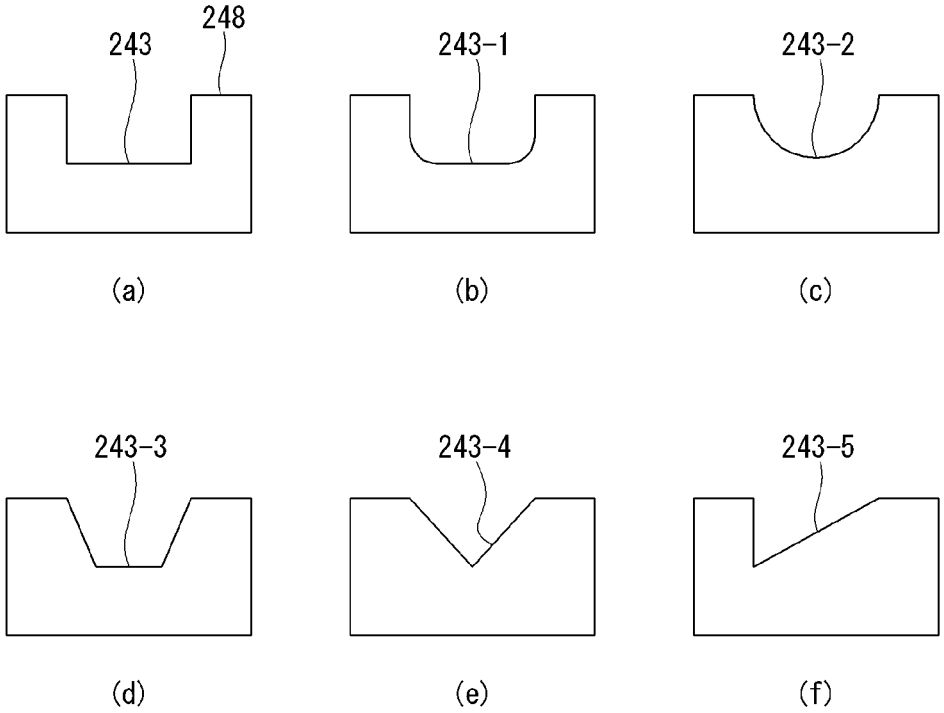
FIG. 19 is a view illustrating various examples of a cross-sectional shape of a gas supply passage.

FIG. 19 is a view illustrating various embodiments of a cross-sectional shape of a gas supply passage.

Referring to FIG. 19, the cross-sectional shape of the gas supply passage 243 may be provided in various shapes.

For example, the cross-sectional shape of the gas supply passage 243 may be provided as a square 243, a part of a circle 243-2, a narrowed trapezoid 243-3, a triangle 243-4.

In addition, when the cross-sectional shape of the gas supply passage 243-1 is provided in a polygonal shape, corners thereof may be rounded.

In addition, when the cross-sectional shape of the gas supply passage 243-5 is provided in a triangular shape, it may be provided in an asymmetric shape inclined to one side rather than a symmetric shape. That is, one surface of the gas supply passage 243-5 may be concave vertically and the other surface thereof may be provided to be inclined.

Figure 20:
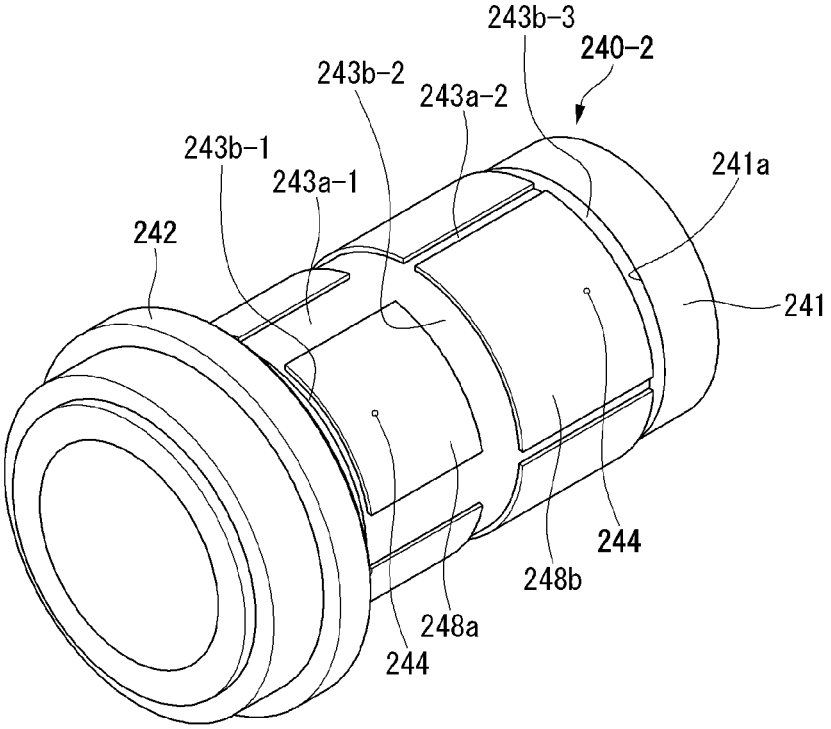
FIG. 20 is a perspective view illustrating a cylinder according to a third embodiment.

FIG. 20 is a perspective view illustrating a cylinder 240-2 according to a third embodiment.

Referring to FIG. 20, the cylinder 240-2 according to the third embodiment may be provided such that a gas supply passage 243 at a front part of the cylinder 240-2 and a gas supply passage 243 at a rear part of the cylinder 240-2 are different in width and depth.

The first-directional gas supply passage 243*a* may include a first-directional first gas supply passage 243*a* connecting the second-directional first gas supply passage 243*b*-1 and the second-directional second gas supply passage 243*b*-2 and a first-directional second gas supply passage 243*a*-2 connecting the second-directional second gas supply passage 243*b*-2 and the second-directional third gas supply passage 243*b*-3.

The first-directional first gas supply passage 243*a*-1 and the first-directional second gas supply passage 243*a*-2 may have different widths or depths.

For example, the width of the first-directional first gas supply passage 243*a*-1 may be wider than the width of the first-directional second gas supply passage 243*a*-2. Since a flow resistance of the first-directional first gas supply passage 243*a*-1 is smaller than a flow resistance of the first-directional second gas supply passage 243*a*-2, the flow rate of the refrigerant passing through the gas supply passage 243 at the front part of the cylinder 240-2 may increase.

In the second-directional gas supply passage 243*b*, the second-directional first gas supply passage 243*b*-1, the second-directional second gas supply passage 243*b*-2, and the second-directional third gas supply passage 243*b*-3 may be provided to have different widths and depths.

For example, the width of the second-directional second gas supply passage 243*b*-2 may be larger than the width of the second-directional third gas supply passage 243*b*-3. Since the flow resistance of the second-directional second gas supply passage 243*b*-2 is smaller than the flow resistance of the second-directional third gas supply passage 243*b*-3, the flow rate of the refrigerant passing through the gas supply passage 243 at the front part of the cylinder 240-2 may increase.

The restrictor region 248 may include a first restrictor region 248*a* surrounded by the first-directional first gas supply passage 243*a*-1, the second-directional first gas supply passage 243*b*-1, and the second-directional second gas supply passage 243*b*-2 and a second restrictor region 248*b* surrounded by the first-directional second gas supply passage 243*a*-2, the second-directional second gas supply passage 243*b*-2, and the second-directional third gas supply passage 243*b*-3.

The width of the first restrictor region 248*a* and the width of the second restrictor region 248*b* may be different from each other. As mentioned above, when the area of the gas supply passage 243 at the front part of the cylinder 240-2 is larger, the width of the first restrictor region 248*a* may be smaller than the width of the second restrictor region 248*b*.

Figure 21:
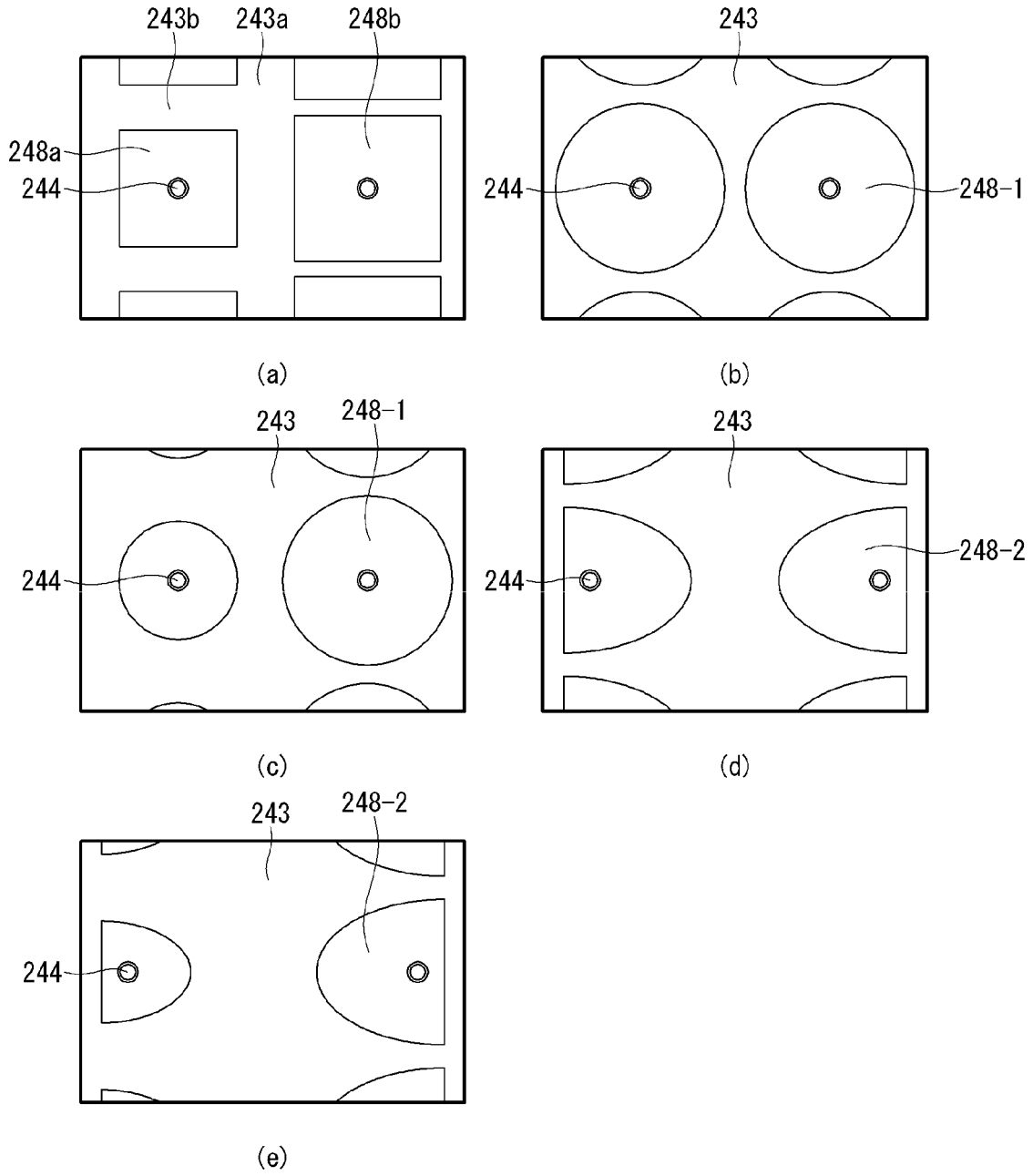
FIG. 21 is a view illustrating various examples of a restrictor region.

FIG. 21 is a view illustrating various embodiments of the restrictor region 248.

Referring to FIG. 21, the restrictor region may include a square shape 248, a circular shape 248-1, an elliptical shape, or a partial shape 248-2 of a circular or elliptical shape.

The area of the first restrictor region 248*a* at the front part of the cylinder 240 and the area of the second restrictor region 248*b* at the rear part of the cylinder 240 may be provided to be different. As the area of the first restrictor region 248*a* at the front part of the cylinder 240 decreases, the width of the gas supply passage 243 that divides the first restrictor region 248*a* increases, and thus a large flow rate of refrigerant may pass by at the front part of the cylinder 240.

Certain or other embodiments of the invention described above are not mutually exclusive or distinct from each other. Certain. or other embodiments of the invention described above may be used together or combined with each other in configuration or function.

For example, it means that a component A described in a specific embodiment and/or drawing may be combined with a component B described in another embodiment and/or drawing. That is, it means that, even if the combination of the components is not directly described, the combination is possible except for a case where the combination is described as impossible.

The detailed description should not be construed as being limitative from all aspects, but should be construed as being illustrative. The scope of the present disclosure should be determined by reasonable analysis of the attached claims, and all changes within the equivalent range of the present disclosure are included in the scope of the present disclosure.

The compressor according to the present disclosure may prevent oil introduced through the gas inlet from moving to the sliding part by reducing assembly tolerance between the cylinder and the frame. That is, oil may be prevented from moving in the gas inlet by increasing surface friction acting on the oil by reducing the gap between the cylinder and the frame. With this effect, the compressor according to the present disclosure may have improved durability and reliability by minimizing contact between the piston and the cylinder.

In addition, according to at least one of the embodiments of the present disclosure, oil or foreign matter flowing into the gas inlet are collected and prevented from moving to the sliding part.

In addition, according to at least one of the embodiments of the present disclosure, regardless of a mistake in the coupling process of the cylinder or a durability problem over time, the restrictor function may be maintained and contaminants or oil may be prevented from moving to the gas intake hole.

What is claimed is:

1. A compressor comprising:

a cylinder in which a piston is accommodated, the cylinder defining a compression space that is configured, based on the piston reciprocating in an axial direction, to compress a refrigerant gas therein; and a frame configured to accommodate the cylinder therein and defining a gas hole configured to pass the refrigerant gas therethrough, wherein a first side of the gas hole is in fluid communication with an outside of the frame to receive the refrigerant gas, and a second side of the gas hole is in fluid communication with a gas pocket that is defined between an inner circumferential surface of the frame and an outer circumferential surface of the cylinder, wherein the outer circumferential surface of the cylinder provides a plurality of restrictor regions partitioned by a gas supply passage, the gas supply passage defined to be recessed at the outer circumferential surface of the cylinder and in fluid communication with the gas hole, wherein each of the plurality of restrictor regions defines a gas intake hole that is in fluid communication with an inner space of the cylinder and the gas pocket, wherein the gas intake hole is defined at an outermost circumferential surface of the restrictor region provided at the outer circumferential surface of the cylinder, wherein the gas intake hole is defined within each of the plurality of the restrictor regions, and wherein an interval between the inner circumferential surface of the frame and the outer circumferential surface of the cylinder is provided within a range of 5 to 10 micrometers in the restrictor region.

2. The compressor of claim 1, wherein the gas supply passage comprises a plurality of first-directional gas supply passages extending in a longitudinal direction of the cylinder and a plurality of second-directional gas supply passages extending in a circumferential direction of the cylinder, wherein the plurality of restrictor regions is partitioned by the plurality of first-directional gas supply passages and the plurality of second-directional gas supply passages.

3. The compressor of claim 2, wherein the plurality of first-directional gas supply passages is spaced apart from each other along the circumferential direction of the cylinder, wherein the plurality of second-directional gas supply passages is spaced apart from each other along the longitudinal direction of the cylinder, and wherein the plurality of restrictor regions is provided in the longitudinal direction of the cylinder and the circumferential direction of the cylinder.

4. The compressor of claim 3, wherein the plurality of restrictor regions arranged along the circumferential direction of the cylinder has an identical width in the axial direction.

5. The compressor of claim 4, wherein the plurality of restrictor regions provided in the longitudinal direction of the cylinder has different widths from each other in the axial direction.

6. The compressor of claim 5, wherein a first restrictor region of the plurality of restrictor regions provided at a first part of the cylinder or the frame facing the first part of the cylinder has a width shorter than a width of a second restrictor region of the plurality of restrictor regions provided at a second part of the cylinder or the frame facing the second part of the cylinder.

7. The compressor of claim 3, wherein the plurality of second-directional gas supply passages has different widths from each other in the longitudinal direction of the cylinder.

8. The compressor of claim 7, wherein a first second-directional gas supply passage of the plurality of second-directional gas supply passages defined at a first part of the cylinder or the frame facing the first part of the cylinder has a width longer than a width of a second second-directional gas supply passage of the plurality of second-directional gas supply passages defined at a second part of the cylinder or the frame facing the second part of the cylinder.

9. The compressor of claim 3, wherein the plurality of first-directional gas supply passages has different widths from each other in the longitudinal direction of the cylinder.

10. The compressor of claim 9, wherein a width of a first part of the first-directional gas supply passage is longer than a width of a second part of the second-directional gas supply passage.

11. The compressor of claim 2, wherein the cylinder comprises:

a cylinder body in a cylindrical shape and extending in the axial direction; and a cylinder flange protruding outward in a radial direction from one side of the cylinder and coupled to the frame, wherein the gas supply passage is defined at the cylinder body, and wherein the second-directional gas supply passage comprises a first second-directional gas supply passage defined adjacent to the cylinder flange, a second second-directional gas supply passage spaced apart from the first second-directional gas supply passage by a predetermined distance, and a third second-directional gas supply passage spaced apart from the second second-directional gas supply passage by a predetermined distance.

12. The compressor of claim 11, wherein the third second-directional gas supply passage defines a seating recess in which a sealing member provided between the cylinder and the frame is disposed.

13. The compressor of claim 2, wherein one of the plurality of second-directional gas supply passages is disposed to overlap an outlet of the gas hole.

14. The compressor of claim 1, wherein each restrictor region is provided to have a circular shape, an oval shape, a portion of the circular shape, or a portion of the oval shape.

15. The compressor of claim 1, wherein a width of the gas supply passage is 10 times greater than an interval between the inner circumferential surface of the frame and the outer circumferential surface of the cylinder in the restrictor region.

16. The compressor of claim 1, wherein a depth of the gas supply passage is 10 times greater than an interval between the inner circumferential surface of the frame and the outer circumferential surface of the cylinder in the restrictor region.

17. The compressor of claim 1, wherein the frame comprises:

a frame body having a cylindrical shape and accommodating the cylinder; and a frame flange extending outward in a radial direction from a first part of the frame body and connected to a driving unit configured to drive the piston, and wherein the first side of the gas hole is in fluid communication with a first part of the frame flange and the second side of the gas hole is in fluid communication with an inner side of the frame body.

18. The compressor of claim 17, wherein the frame further comprises a frame connection part configured to connect the frame body and the frame flange, wherein the gas hole extends from an inlet provided at the frame flange in a first direction, molds in a direction adjacent to the cylinder, and extends in a second direction to be connected to an outlet provided at the frame body, and wherein the outlet is provided to overlap a portion of the gas supply passage.

19. The compressor of claim 1, wherein the cylinder defines a first opening at a first end and a second opening at a second end, wherein the piston is inserted through the first opening of the cylinder, and wherein the second opening of the cylinder is configured to be closed by a discharge valve assembly.

* * * * *